US010462597B2

(12) United States Patent
Nakano

(10) Patent No.: US 10,462,597 B2
(45) **Date of Patent: *Oct. 29, 2019**

(54) ACOUSTIC SIGNAL PROCESSING DEVICE AND ACOUSTIC SIGNAL PROCESSING METHOD

(71) Applicant: SONY CORPORATION, Tokyo (JP)

(72) Inventor: Kenji Nakano, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/972,295

(22) Filed: May 7, 2018

(65) Prior Publication Data

US 2018/0255416 A1 Sep. 6, 2018

Related U.S. Application Data

(63) Continuation of application No. 15/305,694, filed as application No. PCT/JP2015/061790 on Apr. 17, 2015, now Pat. No. 9,998,846.

(30) Foreign Application Priority Data

Apr. 30, 2014 (JP) ..... 2014-093511

(51) Int. Cl.
*H04S 7/00* (2006.01)
*H04R 5/02* (2006.01)
(Continued)

(52) U.S. Cl.
CPC ..... *H04S 7/303* (2013.01); *H04R 3/14* (2013.01); *H04R 5/02* (2013.01); *H04R 5/04* (2013.01);
(Continued)

(58) Field of Classification Search
None
See application file for complete search history.

(56) References Cited

U.S. PATENT DOCUMENTS 4,975,954 A 12/1990 Cooper et al.
6,285,766 B1 9/2001 Kumamoto
(Continued)

FOREIGN PATENT DOCUMENTS

CN 101873522 A 10/2010
CN 103947226 A 7/2014
(Continued)

OTHER PUBLICATIONS

International Search Report and Written Opinion of PCT Application No. PCT/JP2015/061790, dated Jun. 23, 2015, 10 pages of English Translation and 08 pages of ISRWO.
(Continued)

*Primary Examiner* — Qin Zhu
(74) *Attorney, Agent, or Firm* — Chip Law Group

(57) ABSTRACT

The present technology relates to a transaural processing unit that performs a predetermined transaural process for an input signal by using a sound source opposite side HRTF and a sound source side HRTF to generate a first acoustic signal and a second acoustic signal. The second acoustic signal contains attenuated components in a first band and a second band. The first band is the lowest band and the second band is the second lowest band in a range of a first frequency or higher frequencies, in bands of appearance of notches in the sound source opposite side HRTF. A subsidiary signal synthesis unit adds a first subsidiary signal constituted by a component in a band of the second acoustic signal to the first acoustic signal to generate a third acoustic signal. The present technology is applicable to an AV amplifier, for example.

11 Claims, 15 Drawing Sheets

(51) Int. Cl.

| | |
|---|---|
| ***H04R 5/04*** | (2006.01) |
| ***H04R 5/00*** | (2006.01) |
| ***H04R 3/14*** | (2006.01) |
| ***H04S 5/00*** | (2006.01) |

(52) U.S. Cl.
CPC ..... *H04S 5/005* (2013.01); *H04S 7/30* (2013.01); *H04S 2400/01* (2013.01); *H04S 2400/11* (2013.01); *H04S 2420/01* (2013.01)

(56) References Cited

U.S. PATENT DOCUMENTS

| | | | |
|---|---|---|---|
| 6,643,375 | B1 | 11/2003 | Philp et al. |
| 7,197,151 | B1 | 3/2007 | Sibbald et al. |
| 2005/0135643 | A1 | 6/2005 | Lee et al. |
| 2008/0025534 | A1 | 1/2008 | Kuhn et al. |
| 2008/0031462 | A1 | 2/2008 | Walsh et al. |
| 2010/0266133 | A1 | 10/2010 | Nakano |
| 2010/0322428 | A1 | 12/2010 | Fukui et al. |
| 2011/0286601 | A1 | 11/2011 | Fukui et al. |
| 2014/0286511 | A1 | 9/2014 | Nakano |

FOREIGN PATENT DOCUMENTS

| | | | |
|---|---|---|---|
| EP | 2785076 | A1 | 10/2014 |
| JP | 2010-258497 | A | 11/2010 |
| JP | 2011-151633 | A | 8/2011 |
| JP | 2011-160179 | A | 8/2011 |
| JP | 2013-110682 | A | 6/2013 |
| WO | 2013/077226 | A1 | 5/2013 |

OTHER PUBLICATIONS

Non-Final Office Action for U.S. Appl. No. 15/305,694, dated Sep. 18, 2017, 16 pages.
Notice of Allowance for U.S. Appl. No. 15/305,694, dated Feb. 13, 2018, 09 pages.
International Preliminary Report on Patentability of PCT Application No. PCT/JP2015/061790, dated Nov. 10, 2016, 10 pages of English Translation and 06 pages of IPRP.

101R
111R
121R
TRANSAURAL PROCESSING UNIT
BINAURAL PROCESSING UNIT
131R
NOTCH-FORMATION EQUALIZER
141R
Sin'
BINAURAL SIGNAL GENERATION UNIT
142R
BINAURAL SIGNAL GENERATION UNIT
142L
BR
BL
151R
f1 (G1, G2)
152R
f2 (G1, G2)
152L
f2 (G1, G2)
151L
f1 (G1, G2)
SR1
SR2
SL2
SL1
153R
153L
SRout1
SLout1
CROSSTALK CORRECTION PROCESSING UNIT
132
SUBSIDIARY SIGNAL GENERATION UNIT
161R
SRsub
162L
SLout2
SUBSIDIARY SIGNAL SYNTHESIS UNIT
122R
Sin
113
HR
HL
112R
112L
G1
G2
ER
EL
P

ACOUSTIC SIGNAL PROCESSING DEVICE AND ACOUSTIC SIGNAL PROCESSING METHOD

CROSS REFERENCE TO RELATED APPLICATIONS

The present application is a continuation application of U.S. patent application Ser. No. 15/305,694, filed on Oct. 21, 2016 which is a National Stage Entry of PCT/JP2015/061790, filed on Apr. 17, 2015, which claims the benefit of priority from Japanese Patent Application JP 2014-093511 filed in the Japan Patent Office on Apr. 30, 2014, the entire contents of each of the above are hereby incorporated by reference.

TECHNICAL FIELD

The present technology relates to an acoustic signal processing device, an acoustic signal processing method, and a program, and more particularly to an acoustic signal processing device, an acoustic signal processing method, and a program for realizing virtual surround.

BACKGROUND ART

There has been proposed a virtual surround system which improves a feeling of localization of a sound image at a position deviated leftward or rightward from a median plane of a listener (for example, see Patent Document 1)

CITATION LIST

Patent Document

Patent Document 1: Japanese Patent Application Laid-Open No. 2013-110682

SUMMARY OF THE INVENTION

Problems to be Solved by the Invention

According to a technology described in Patent Document 1, however, effects of sound image localization decrease when a gain of a sound image localization filter generating output signals for one of speakers becomes significantly small in comparison with a gain of a sound image localization filter generating output signals for the other speaker, for example.

Thus the present technology improves a feeling of localization of a sound image at a position deviated leftward or rightward from a median plane of a listener.

Solutions to Problems

An acoustic signal processing device according to a first aspect of the present technology includes: a first transaural processing unit that performs a predetermined transaural process for a first input signal corresponding to an acoustic signal for a first virtual sound source deviated leftward or rightward from a median plane of a predetermined listening position, by using a first head acoustic transmission function between the first virtual sound source and one of both ears of a listener located at the listening position, which ear is located on a side away from the first virtual sound source, and by using a second head acoustic transmission function between the first virtual sound source and the other of the both ears of the listener, which ear is located on a side close to the first virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function; and a first subsidiary signal synthesis unit that adds a first subsidiary signal constituted by a component in a predetermined band of the second acoustic signal to the first acoustic signal to generate a third acoustic signal.

The band of the first subsidiary signal may at least include the lowest band and the second lowest band in a range of a predetermined second frequency or higher frequencies in bands of appearance of the notches in a third head acoustic transmission function between one of the both ears of the listener and one of two speakers disposed on left and right sides with respect to the listening position, the lowest band and the second lowest band in a range of a predetermined third frequency or higher frequencies in bands of appearance of the notches in a fourth head acoustic transmission function between the other ear of the listener and the other of the two speakers, the lowest band and the second lowest band in a range of a predetermined fourth frequency or higher frequencies in bands of appearance of the notches in a fifth head acoustic transmission function between the other ear and the one speaker, and the lowest band and the second lowest band at a predetermined fifth frequency or higher frequencies in the bands of appearance of notches in a sixth head acoustic transmission function between the one ear and the other speaker.

The acoustic signal processing device may further include: a first delay unit that delays the first acoustic signal by a predetermined time before addition of the first subsidiary signal; and a second delay unit that delays the second acoustic signal by a predetermined time after generation of the first subsidiary signal.

The first subsidiary signal synthesis unit may adjust a level of the first subsidiary signal before addition of the first subsidiary signal to the first acoustic signal.

The acoustic signal processing device may further include: a second transaural processing unit that performs a predetermined transaural process for a second input signal corresponding to an acoustic signal for a second virtual sound source deviated leftward or rightward from the median plane, by using a seventh head acoustic transmission function between the second virtual sound source and one of the both ears of the listener, which ear is located away from the second virtual sound source, and by using an eighth head acoustic transmission function between the second virtual sound source and the other ear of the both ears of the listener, which ear is located close to the second virtual sound source, to generate a fourth acoustic signal, and a fifth acoustic signal containing attenuated components in a third band which is the lowest band, and a fourth band which is the second lowest band in a range of a predetermined sixth frequency or higher frequencies, in bands of appearance of the notches in the seventh head acoustic transmission function; a second subsidiary signal synthesis unit that adds a second subsidiary signal constituted by a component in the fifth acoustic signal in the same band as the band of the first subsidiary signal to the fourth acoustic signal to generate a sixth acoustic signal; and an addition unit that adds the third acoustic signal and the fifth acoustic signal and adds the second acoustic signal to the sixth acoustic signal when positions of the first virtual sound source and the second virtual sound source are separated into a left side and a right side with respect to the median plane, and adds the third acoustic signal to the sixth acoustic signal and adds the second acoustic signal and the fifth acoustic signal when the first virtual sound source and the second virtual sound source are disposed on the same side with respect to the median plane.

The first frequency may be a frequency at which a positive peak appears around 4 kHz in the first head acoustic transmission function.

The first transaural processing unit may include a first binaural processing unit that generates a first binaural signal containing the first input signal and the first head acoustic transmission function superimposed on the first input signal, a second binaural processing unit that generates a second binaural signal which is a signal including the first input signal and the second head acoustic transmission function superimposed on the first input signal, and containing attenuated components in the first band and the second band of the signal, and a crosstalk correction processing unit that performs a crosstalk correction process for the first binaural signal and the second binaural signal for canceling an acoustic transmission characteristic between the ear away from the first virtual sound source and one of two speakers disposed on left and right sides with respect to the listening position, which speaker is located on the side opposite to the first virtual sound source with respect to the median plane, an acoustic transmission characteristic between the ear close to the first virtual sound source and the other speaker of the two speakers, which speaker is located on the virtual sound source side with respect to the median plane, a crosstalk from the speaker on the side opposite to the first virtual sound source to the ear close to the first virtual sound source, and a crosstalk from the virtual sound source side speaker to the ear away from the first virtual sound source.

The first binaural processing unit may generate a third binaural signal that contains attenuated components in the first band and the second band of the first binaural signal. The crosstalk correction processing unit may perform the crosstalk correction process for the second binaural signal and the third binaural signal.

The first transaural processing unit may include an attenuation unit that generates an attenuation signal containing attenuated components in the first band and the second band of the first input signal, and a signal processing unit that performs, as a unified process, a process for generating a first binaural signal containing the attenuation signal and the first head acoustic transmission function superimposed on the attenuation signal, and a second binaural signal containing the attenuation signal and the second head acoustic transmission function superimposed on the attenuation signal, and a process for the first binaural signal and the second binaural signal for canceling an acoustic transmission characteristic between the ear away from the first virtual sound source and one of two speakers disposed on left and right sides with respect to the listening position, which speaker is located on the side opposite to the first virtual sound source with respect to the median plane, an acoustic transmission characteristic between the ear close to the first virtual sound source and the other speaker of the two speakers, which speaker is located on the virtual sound source side with respect to the median plane, a crosstalk from the speaker on the side opposite to the first virtual sound source to the ear close to the first virtual sound source, and a crosstalk from the virtual sound source side speaker to the ear away from the first virtual sound source.

An acoustic signal processing method according to the first aspect of the present technology includes: a transaural processing step that performs a predetermined transaural process for an input signal corresponding to an acoustic signal for a virtual sound source deviated leftward or rightward from a median plane of a predetermined listening position, by using a first head acoustic transmission function between the virtual sound source and one of both ears of a listener located at the listening position, which ear is located on a side away from the virtual sound source, and by using a second head acoustic transmission function between the virtual sound source and the other of the both ears of the listener located at the listening position, which ear is located on a side close to the virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function; and a subsidiary signal synthesis step that adds a subsidiary signal constituted by a component in a predetermined band of the second acoustic signal to the first acoustic signal to generate a third acoustic signal.

A program according to the first aspect of the present technology is a program causing a computer to execute a process including: a transaural processing step that performs a predetermined transaural process for an input signal corresponding to an acoustic signal for a virtual sound source deviated leftward or rightward from a median plane of a predetermined listening position, by using a first head acoustic transmission function between the virtual sound source and one of both ears of a listener located at the listening position, which ear is located on a side away from the virtual sound source, and by using a second head acoustic transmission function between the virtual sound source and the other of the both ears of the listener located at the listening position, which ear is located on a side close to the virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function; and a subsidiary signal synthesis step that adds a subsidiary signal constituted by a component in a predetermined band of the second acoustic signal to the first acoustic signal to generate a third acoustic signal.

An acoustic signal processing device according to a second aspect of the present technology includes: a subsidiary signal synthesis unit that adds a first subsidiary signal to a first input signal to generate a first synthesis signal, and adds a second subsidiary signal to a second input signal to generate a second synthesis signal, the first input signal corresponding to an acoustic signal for a first virtual sound source deviated leftward or rightward from a median plane of a predetermined listening position, the second input signal corresponding to an acoustic signal for a second virtual sound source deviated leftward or rightward from the median plane, the first subsidiary signal constituted by a component in a predetermined band of the second input signal, and the second subsidiary signal constituted by a component in the first input signal in the same band as the band of the first subsidiary signal; a first transaural processing unit that performs a predetermined transaural process for the first synthesis signal by using a first head acoustic transmission function between the first virtual sound source and one of both ears of a listener located at the listening position, which ear is located on a side away from the first virtual sound source, and by using a second head acoustic transmission function between the first virtual sound source and the other of the both ears of the listener, which ear is located on a side close to the first virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function; and a second transaural processing unit that performs a predetermined transaural process for the second synthesis signal by using a third head acoustic transmission function between the second virtual sound source and one of the both ears of the listener, which ear is located away from the second virtual sound source, and by using a fourth head acoustic transmission function between the second virtual sound source and the other ear of the both ears of the listener, which ear is located close to the second virtual sound source, to generate a third acoustic signal, and a fourth acoustic signal containing attenuated components in a third band which is the lowest band, and a fourth band which is the second lowest band in a range of a predetermined second frequency or higher frequencies, in bands of appearance of the notches in the third head acoustic transmission function.

The acoustic signal processing device may further include an addition unit that adds the first acoustic signal and the fourth acoustic signal and adds the second acoustic signal and the third acoustic signal when positions of the first virtual sound source and the second virtual sound source are separated into a left side and a right side with respect to the median plane, and adds the first acoustic signal and the third acoustic signal and adds the second acoustic signal and the fourth acoustic signal when the first virtual sound source and the second virtual sound source are disposed on the same side with respect to the median plane.

The bands of the first subsidiary signal and the second subsidiary signal may at least include the lowest band and the second lowest band in a range of a predetermined third frequency or higher frequencies in bands of appearance of the notches in a fifth head acoustic transmission function between one of the both ears of the listener and one of two speakers disposed on left and right sides with respect to the listening position, the lowest band and the second lowest band in a range of a predetermined fourth frequency or higher frequencies in bands of appearance of the notches in a sixth head acoustic transmission function between the other ear of the listener and the other of the two speakers, the lowest band and the second lowest band in a range of a predetermined fifth frequency or higher frequencies in bands of appearance of the notches in a seventh head acoustic transmission function between the other ear and the one speaker, and the lowest band and the second lowest band at a predetermined sixth frequency or higher frequencies in the bands of appearance of notches in an eighth head acoustic transmission function between the one ear and the other speaker.

The first frequency may be a frequency at which a positive peak appears around 4 kHz in the first head acoustic transmission function. The second frequency may be a frequency at which a positive peak appears around 4 kHz in the third head acoustic transmission function.

The first transaural processing unit may include a first binaural processing unit that generates a first binaural signal containing the first synthesis signal and the first head acoustic transmission function superimposed on the first synthesis signal, a second binaural processing unit that generates a second binaural signal which is a signal including the first synthesis signal and the second head acoustic transmission function superimposed on the first synthesis signal, and containing attenuated components in the first band and the second band of the signal, and a first crosstalk correction processing unit that performs a crosstalk correction process for the first binaural signal and the second binaural signal for canceling an acoustic transmission characteristic between the ear away from the first virtual sound source and one of two speakers disposed on left and right sides with respect to the listening position, which speaker is located on the side opposite to the first virtual sound source with respect to the median plane, an acoustic transmission characteristic between the ear close to the first virtual sound source and the other speaker of the two speakers, which speaker is located on the first virtual sound source side with respect to the median plane, a crosstalk from the speaker on the side opposite to the first virtual sound source to the ear close to the first virtual sound source, and a crosstalk from the first virtual sound source side speaker to the ear away from the first virtual sound source. The second transaural processing unit may include a third binaural processing unit that generates a third binaural signal containing the second synthesis signal and the third head acoustic transmission function superimposed on the second synthesis signal, a fourth binaural processing unit that generates a fourth binaural signal which is a signal including the second synthesis signal and the fourth head acoustic transmission function superimposed on the second synthesis signal, and containing attenuated components in the third band and the fourth band of the signal, and a second crosstalk correction processing unit that performs a crosstalk correction process for the third binaural signal and the fourth binaural signal for canceling an acoustic transmission characteristic between the ear away from the second virtual sound source and one of two speakers, which speaker is located on the side opposite to the second virtual sound source with respect to the median plane, an acoustic transmission characteristic between the ear close to the second virtual sound source and the other speaker of the two speakers, which speaker is located on the second virtual sound source side with respect to the median plane, a crosstalk from the speaker on the side opposite to the second virtual sound source to the ear close to the second virtual sound source, and a crosstalk from the second virtual sound source side speaker to the ear away from the second virtual sound source.

The first binaural processing unit may generate a fifth binaural signal that contains attenuated components in the first band and the second band of the first binaural signal. The first crosstalk correction processing unit may perform the crosstalk correction process for the second binaural signal and the fifth binaural signal. The third binaural processing unit may generate a sixth binaural signal that contains attenuated components in the third band and the fourth band of the third binaural signal. The second crosstalk correction processing unit may perform the crosstalk correction process for the fourth binaural signal and the sixth binaural signal.

The first transaural processing unit may include a first attenuation unit that generates a first attenuation signal containing attenuated components in the first band and the second band of the first synthesis signal, and a first signal processing unit that performs, as a unified process, a process for generating a first binaural signal containing the first attenuation signal and the first head acoustic transmission function superimposed on the first attenuation signal, and a second binaural signal containing the first attenuation signal and the second head acoustic transmission function superimposed on the first attenuation signal, and a process for the first binaural signal and the second binaural signal for canceling an acoustic transmission characteristic between the ear away from the first virtual sound source and one of two speakers disposed on left and right sides with respect to the listening position, which speaker is located on the side opposite to the first virtual sound source with respect to the median plane, an acoustic transmission characteristic between the ear close to the first virtual sound source and the other speaker of the two speakers, which speaker is located on the first virtual sound source side with respect to the median plane, a crosstalk from the speaker on the side opposite to the first virtual sound source to the ear close to the first virtual sound source, and a crosstalk from the first virtual sound source side speaker to the ear away from the first virtual sound source. The second transaural processing unit may include a second attenuation unit that generates a second attenuation signal containing attenuated components in the third band and the fourth band of the second synthesis signal, and a third signal processing unit that performs, as a unified process, a process for generating a third binaural signal containing the second attenuation signal and the third head acoustic transmission function superimposed on the second attenuation signal, and a fourth binaural signal containing the second attenuation signal and the fourth head acoustic transmission function superimposed on the second attenuation signal, and a process for the third binaural signal and the fourth binaural signal for canceling an acoustic transmission characteristic between the ear away from the second virtual sound source and one of two speakers, which speaker is located on the side opposite to the second virtual sound source with respect to the median plane, an acoustic transmission characteristic between the ear close to the second virtual sound source and the other speaker of the two speakers, which speaker is located on the second virtual sound source side with respect to the median plane, a crosstalk from the speaker on the side opposite to the second virtual sound source to the ear close to the second virtual sound source, and a crosstalk from the second virtual sound source side speaker to the ear away from the second virtual sound source.

An acoustic signal processing method according to the second aspect of the present technology includes: a subsidiary signal synthesis step that adds a first subsidiary signal to a first input signal to generate a first synthesis signal, and adds a second subsidiary signal to a second input signal to generate a second synthesis signal, the first input signal corresponding to an acoustic signal for a first virtual sound source deviated leftward or rightward from a median plane of a predetermined listening position, the second input signal corresponding to an acoustic signal for a second virtual sound source deviated leftward or rightward from the median plane, the first subsidiary signal constituted by a component in a predetermined band of the second input signal, and the second subsidiary signal constituted by a component in the first input signal in the same band as the band of the first subsidiary signal; a first transaural processing step that performs a predetermined transaural process for the first synthesis signal by using a first head acoustic transmission function between the first virtual sound source and one of both ears of a listener located at the listening position, which ear is located on a side away from the first virtual sound source, and by using a second head acoustic transmission function between the first virtual sound source and the other of the both ears of the listener, which ear is located on a side close to the first virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function; and a second transaural processing step that performs a predetermined transaural process for the second synthesis signal by using a third head acoustic transmission function between the second virtual sound source and one of the both ears of the listener, which ear is located away from the second virtual sound source, and by using a fourth head acoustic transmission function between the second virtual sound source and the other ear of the both ears of the listener, which ear is located close to the second virtual sound source, to generate a third acoustic signal, and a fourth acoustic signal containing attenuated components in a third band which is the lowest band, and a fourth band which is the second lowest band in a range of a predetermined second frequency or higher frequencies, in bands of appearance of the notches in the third head acoustic transmission function.

A program according to the second aspect of the present technology is a program causing a computer to execute a process including: a subsidiary signal synthesis step that adds a first subsidiary signal to a first input signal to generate a first synthesis signal, and adds a second subsidiary signal to a second input signal to generate a second synthesis signal, the first input signal corresponding to an acoustic signal for a first virtual sound source deviated leftward or rightward from a median plane of a predetermined listening position, the second input signal corresponding to an acoustic signal for a second virtual sound source deviated leftward or rightward from the median plane, the first subsidiary signal constituted by a component in a predetermined band of the second input signal, and the second subsidiary signal constituted by a component in the first input signal in the same band as the band of the first subsidiary signal; a first transaural processing step that performs a predetermined transaural process for the first synthesis signal by using a first head acoustic transmission function between the first virtual sound source and one of both ears of a listener located at the listening position, which ear is located on a side away from the first virtual sound source, and by using a second head acoustic transmission function between the first virtual sound source and the other of the both ears of the listener, which ear is located on a side close to the first virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function; and a second transaural processing step that performs a predetermined transaural process for the second synthesis signal by using a third head acoustic transmission function between the second virtual sound source and one of the both ears of the listener, which ear is located away from the second virtual sound source, and by using a fourth head acoustic transmission function between the second virtual sound source and the other ear of the both ears of the listener, which ear is located close to the second virtual sound source, to generate a third acoustic signal, and a fourth acoustic signal containing attenuated components in a third band which is the lowest band, and a fourth band which is the second lowest band in a range of a predetermined second frequency or higher frequencies, in bands of appearance of the notches in the third head acoustic transmission function.

According to the first aspect of the present technology, a predetermined transaural process is performed for an input signal corresponding to an acoustic signal for a virtual sound source deviated leftward or rightward from a median plane of a predetermined listening position, by using a first head acoustic transmission function between the virtual sound source and one of both ears of a listener located at the listening position, which ear is located on a side away from the virtual sound source, and by using a second head acoustic transmission function between the virtual sound source and the other of the both ears of the listener located at the listening position, which ear is located on a side close to the first virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function. A subsidiary signal constituted by a component in a predetermined band of the second acoustic signal is added to the first acoustic signal to generate a third acoustic signal.

According to the second aspect of the present technology, a first subsidiary signal is added to a first input signal to generate a first synthesis signal, while a second subsidiary signal is added to the second input signal to generate a second synthesis signal. The first input signal corresponds to an acoustic signal for a first virtual sound source deviated leftward or rightward from a median plane of a predetermined listening position. The first subsidiary signal is constituted by a component in a predetermined band of a second input signal corresponding to an acoustic signal for a second virtual sound source deviated leftward or rightward from the median plane. The second subsidiary signal is constituted by a component in the first input signal in the same band as the band of the first subsidiary signal. A predetermined transaural process is performed for the first synthesis signal by using a first head acoustic transmission function between the first virtual sound source and one of both ears of a listener located at the listening position, which ear is located on a side away from the first virtual sound source, and by using a second head acoustic transmission function between the first virtual sound source and the other of the both ears of the listener located at the listening position, which ear is located on a side close to the first virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function. A predetermined transaural process is performed for the second synthesis signal by using a third head acoustic transmission function between the second virtual sound source and one of the both ears of the listener, which ear is located away from the second virtual sound source, and by using a fourth head acoustic transmission function between the second virtual sound source and the other ear of the both ears of the listener, which ear is located close to the second virtual sound source, to generate a third acoustic signal, and a fourth acoustic signal containing attenuated components in a third band which is the lowest band, and a fourth band which is the second lowest band in a range of a predetermined second frequency or higher frequencies, in bands of appearance of the notches in the third head acoustic transmission function.

Effects of the Invention

According to the first aspect or the second aspect of the present technology, a sound image is localized at a position deviated leftward or rightward from a median plane of a listener. Moreover, according to the first aspect or the second aspect of the present technology, a feeling of localization of a sound image at a position deviated leftward or right ward from a median plane of a listener improves.

Note that advantages to be offered are not limited to these advantages, but may be any of advantages described in the present disclosure.

MODE FOR CARRYING OUT THE INVENTION

Embodiments for carrying out the present technology (hereinafter referred to as embodiments) are described hereinbelow. Note that the respective embodiments are described in the following order.

1. Description of technology on which the present technology is based
2. First embodiment (example providing notch formation equalizer only on sound source side)
3. Second embodiment (example providing notch formation equalizer on both sound source side and sound source opposite side)
4. Third embodiment (example performing unified transaural process)
5. Fourth embodiment (example producing a plurality of virtual speakers)
6. Modified examples

1. Description of Technology on which the Present Technology is Based

A technology on which the present technology is based is initially described with reference to FIGS. 1 and 2.

It has been known that a peak and a dip appearing in a high range of amplitude-frequency characteristics of a head-related transfer function (HRTF) are significant clues for a feeling of localization of a sound image in up-down and front-rear directions (for example, see "Spatial Acoustics", pp. 19 to 21, Iida et al., Japan, CORONA PUBLISHING CO., LTD., July, 2010 (hereinafter referred to as Non-Patent Document 1). It is considered that these peak and dip are chiefly generated by reflection, diffraction, and resonance caused by an ear shape.

Figure 1:
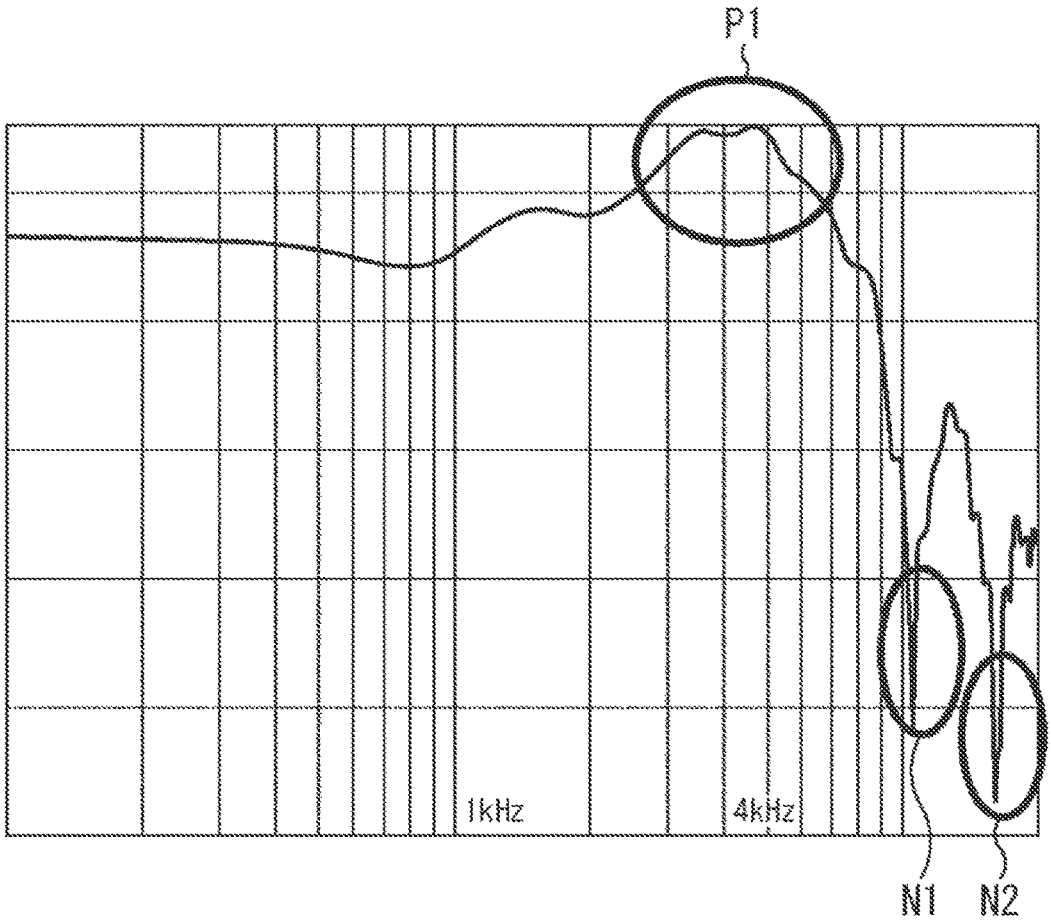
FIG. 1 is a graph showing an example of an HRTF.

Non-patent Document 1 further indicates that each of a positive peak P1 appearing around 4 kHz, and two notches N1 and N2 initially appearing in bands equal to or higher than a frequency at which the peak P1 appears has a high contribution rate particularly to a feeling of localization of a sound image in the up-down and front-rear directions as illustrated in FIG. 1.

According to the present specification, the dip herein refers to a recessed portion in comparison with surroundings in a waveform chart of an HRTF showing amplitude-frequency characteristics or the like. On the other hand, the notch refers to a peak having a width (such as band in amplitude-frequency characteristics of HRTF) which is particularly small, and having a predetermined depth or larger, i.e., a negative sharp peak appearing in a waveform chart. In addition, the notch N1 and the notch N2 in FIG. 1 are hereinafter also referred to as a first notch and a second notch, respectively.

No directional dependency of the peak P1 is recognizable concerning a sound source direction. The peak P1 appears substantially in the same band regardless of a sound source direction. Moreover, according to Non-patent Document 1, the peak P1 is a reference signal for a human auditory system to search the first notch and the second notch. The first notch and the second notch are considered as physical parameters substantially contributing to a feeling of localization in the up-down and front-rear directions.

Moreover, Patent Document 1 described above indicates that the first notch and the second notch appearing in a sound source opposite side HRTF play an important role for a feeling of localization of a sound image in the up-down and front-rear directions when the position of a sound source deviates leftward or rightward from a median plane of a listener. Furthermore, when the first notch and the second notch of the sound source opposite side HRTF are reproduced in the vicinity of the ear of the listener on the sound source opposite side, an amplitude of sound in bands of appearance of these notches in the vicinity of the ear on the sound source side does not have a significant effect on a feeling of localization of the sound image in the up-down and front-rear direction, as indicated in Patent Document 1.

The sound source side herein refers to the side close to a sound source in the left-right direction with respect to a listening position, while the sound source opposite side refers to the side away from a sound source. In other words, the sound source side is the same side as the side of a sound source when a space is divided into left side and right side with respect to a median plane of a listener located at a listening position, while the sound source opposite side is the side opposite to the sound source side. In addition, the sound source side HRTF is a HRTF corresponding to a sound source side ear of a listener, while the sound source opposite side HRTF is a HRTF corresponding to a sound source opposite side ear of a listener. Note that the ear of a listener on the sound source opposite side is hereinafter also referred to as a shadow side ear.

According to the technology described in Patent Document 1, a transaural process is performed by utilizing the theory described above, after notches are formed in a sound source side acoustic signal in the same bands as the bands of appearance of the first notch and the second notch in the sound source opposite side HRTF of a virtual speaker. In this case, the first notch and the second notch are reproduced in a stable condition in the vicinity of the sound source opposite side ear. Accordingly, the position of the virtual speaker in the up-down and left-right direction is stabilized.

The transaural process is briefly described herein.

A method known as a binaural recording/reproducing system reproduces sound in the vicinity of both ears by using a headphone, which sound has been recorded with a microphone disposed in the vicinity of both ears. Two-channel signals recorded by binaural recording are called binaural signals, and contain acoustic information on a position of a sound source in the up-down and front-rear directions for a human as well as the left-right direction.

There is also a method called transaural reproduction system which reproduces these binaural signals by using two-channel speakers on left side and right side, instead of a headphone. However, when sound based on the binaural signals is output from the speakers without change, there may occur a crosstalk which allows sound for the right ear of the listener to be heard by the left ear of the listener as well, for example. Furthermore, acoustic transmission characteristics transmitted from the speaker to the right ear may be superimposed on the sound for the right ear in a period until the sound for the right ear reaches the right ear of the listener, for example. In this case, waveform deformation may be caused.

Accordingly, in case of the transaural reproduction system, preprocessing for canceling a crosstalk and unnecessary acoustic transmission characteristics is performed for binaural signals. This preprocessing is hereinafter referred to as a crosstalk correction process.

Incidentally, generation of binaural signals is realizable without recording with a microphone in the vicinity of ears. More specifically, binaural signals are signals produced by superimposing an HRTF on an acoustic signal. This HRTF ranges from the corresponding sound source position to the vicinity of the both ears. Accordingly, a signal process for superimposing an HRTF on an acoustic signal is performed to generate a binaural signal when the HRTF to be superimposed is known. This process is hereinafter referred to as a binaural process.

In case of a front surround system based on an HRTF, the foregoing binaural process and crosstalk correction process are performed. The front surround system herein is a virtual surround system which creates a pseudo surround sound field only by using a front speaker. The transaural process herein is a process performed as a combination of the binaural process and the crosstalk correction process.

According to the technology described in Patent Document 1, however, a feeling of localization of a sound image deteriorates when the volume of one of speakers becomes significantly small in comparison with the volume of the other speaker. The reason for this deterioration is herein described with reference to FIG. 2.

Figure 2:
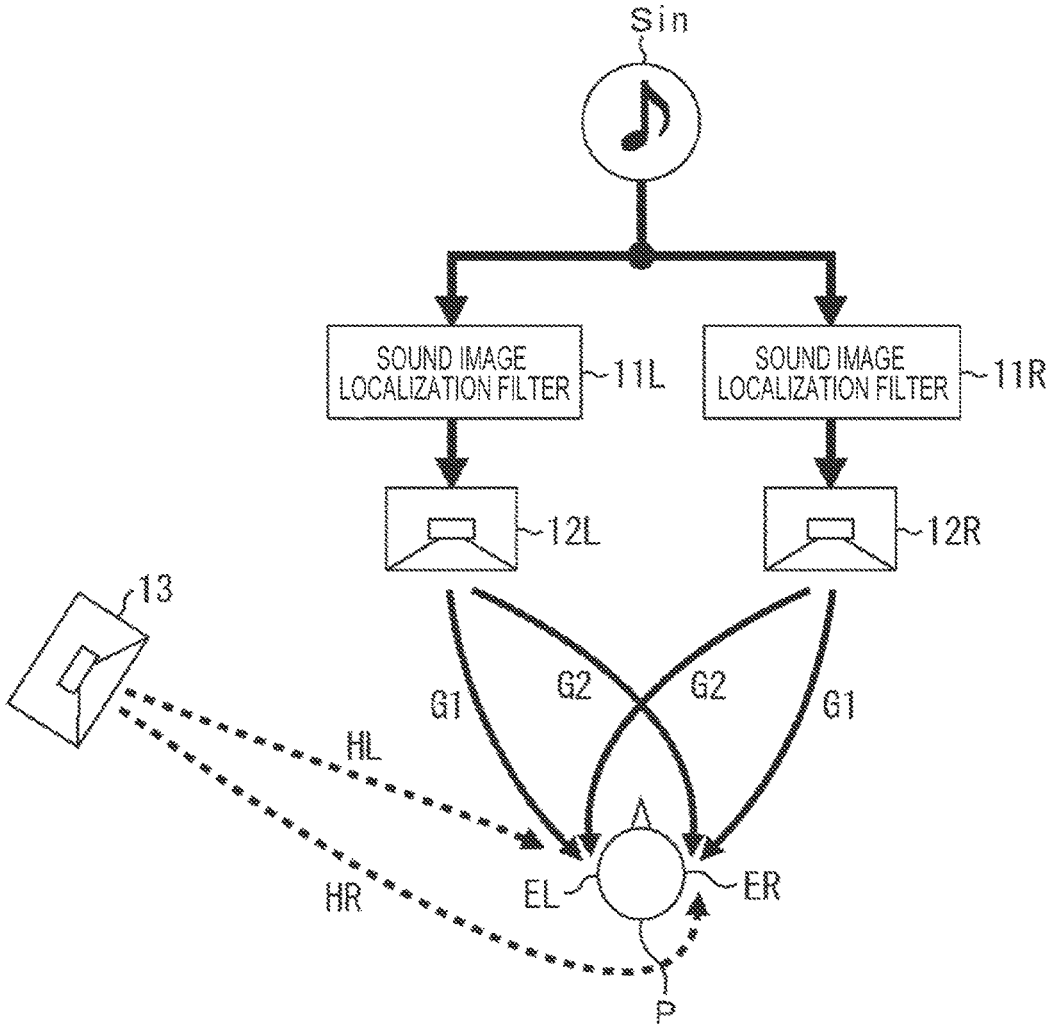
FIG. 2 is a view illustrating a technology on which the present technology is based.

FIG. 2 illustrates an example of localization of an image of sound at a position of a virtual speaker 13 by using sound image localization filters 11L and 11R. This sound is output from speakers 12L and 12R to a listener P located at a predetermined listening position. Note that discussed hereinbelow is a case when the position of the virtual speaker 13 is set at a diagonally upper left position in front of a listening position (listener P).

Note that a sound source side HRTF between the virtual speaker 13 and a left ear EL of the listener P is hereinafter referred to as a head acoustic transmission function HL, and that a sound source opposite side HRTF between the virtual speaker 13 and a right ear ER of the listener P is hereinafter referred to as a head acoustic transmission function HR. It is also assumed hereinbelow that the HRTF between the speaker 12L and the left ear EL of the listener P is identical to the HRTF between the speaker 12R and the right ear ER of the listener P for simplifying the description. The corresponding HRTF is referred to as a head acoustic transmission function G1. Similarly, it is assumed that the HRTF between the speaker 12L and the right ear ER of the listener P is identical to the HRTF between the speaker 12R and the left ear EL of the listener P. The corresponding HRTF is referred to as a head acoustic transmission function G2.

As illustrated in FIG. 2, the head acoustic transmission function G1 is superimposed on sound generated from the speaker 12L in a period until the sound reaches the left ear EL of the listener P, while the head acoustic transmission function G2 is superimposed on sound generated from the speaker 12R in a period until the sound reaches the left ear EL of the listener P. When the sound image localization filters 11L and 11R perform ideal operations in this condition, a waveform of sound generated from both the speakers and synthesized at the left ear EL becomes a waveform of an acoustic signal Sin on which the head acoustic transmission function HL is superimposed in a state of cancellation between effects of the head acoustic transmission functions G1 and G2.

Similarly, the head acoustic transmission function G1 is superimposed on sound generated from the speaker 12R in a period until the sound reaches the right ear ER of the listener P, while the head acoustic transmission function G2 is superimposed on sound generated from the speaker 12L in a period until the sound reaches the right ear ER of the listener P. When the sound image localization filters 11L and 11R perform ideal operations in this condition, a waveform of sound generated from both the speakers and synthesized at the right ear ER becomes a waveform of an acoustic signal Sin on which the head acoustic transmission function HR is superimposed in a state of cancellation between effects of the head acoustic transmission functions G1 and G2.

When notches are formed in the acoustic signal Sin input to the sound source side sound image localization filter 11L as notches formed in the same bands as the bands of the first notch and the second notch in the sound source opposite side head acoustic transmission function HR by applying the technology described in Patent Document 1, the first notch and the second notch in the head acoustic transmission function HL, and notches substantially in the same bands as the bands of the first notch and the second notch of the head acoustic transmission function HR appear in the left ear EL of the listener P. Also, the first notch and the second notch of the head acoustic transmission function HR appear in the right ear ER of the listener P. Accordingly, the first notch and the second notch of the head acoustic transmission function HR are reproduced in a stable manner in the shadow side right ear ER of the listener P, wherefore the position of the virtual speaker 13 in the up-down and front-rear directions is stabilized.

However, this situation occurs only when an ideal crosstalk correction is performed. In reality, it is difficult to completely cancel a crosstalk and unnecessary acoustic transmission characteristics by using the sound image localization filters 11L and 11R. This difficulty is produced by filter error performance caused by the necessity for realizing a practical scale generally required for constituting the filters 11L and 11R, or by errors caused by disagreement between a normal sample listening position and an ideal position in spatial acoustic signal synthesis. Particularly in this case, it is difficult to reproduce the first notch and the second notch of the head acoustic transmission function HL for the left ear EL, which notches should be reproduced only in one of the ears. However, the first notch and the second notch for the right ear HR are formed for the overall signals, wherefore reproducibility of these notches becomes preferable.

Effects of the first notch and the second notch appearing in the head acoustic transmission functions G1 and G2 under this situation are now considered hereinbelow.

The bands of the first notch and the second notch in the head acoustic transmission function G1 generally do not agree with the bands of the first and notch and the second notch in the head acoustic transmission function G2. Accordingly, when each volume of the speaker 12L and the speaker 12R has a significant level, the first notch and the second notch in the head acoustic transmission function G1 are canceled by the sound generated from the speaker 12R in the left ear EL of the listener P, while the first notch and the second notch in the head acoustic transmission function G2 are canceled by the sound generated from the speaker 12L in the left ear EL of the listener P. Similarly, the first notch and the second notch in the head acoustic transmission function G1 are canceled by the sound generated from the speaker 12L in the right ear ER of the listener P, while the first notch and the second notch in the head acoustic transmission function G2 are canceled by the sound generated from the speaker 12R in the right ear ER of the listener P.

Accordingly, notches disappear in the head acoustic transmission functions G1 and G2 in the both ears of the listener P, and therefore do not affect a feeling of localization of the virtual speaker 13. As a result, the position of the virtual speaker 13 in the up-down and front-rear direction is stabilized.

On the other hand, when the volume of the speaker 12R is significantly small with respect to the volume of the speaker 12L, substantially no sound generated from the speaker 12R reaches the both ears of the listener P. As a result, the first notch and the second notch in the head acoustic transmission function G1 do not disappear but remain in the left ear EL of the listener P. Also, the first notch and the second notch in the head acoustic transmission function G2 do not disappear but remain in the right ear ER of the listener P.

Accordingly, in the actual crosstalk correction process, the first notch and the second notch of the head acoustic transmission function G1 appear in the left ear EL of the listener P in addition to the notches substantially in the same bands as the bands of the first notch and the second notch of the head acoustic transmission function HR. In other words, two pairs of notches are simultaneously formed. Also, the first notch and the second notch of the head acoustic transmission function G2 appear in the right ear ER of the listener P in addition to the first notch and the second notch of the head acoustic transmission function HR. In other words, two pairs of notches are simultaneously formed.

As discussed above, notches other than those in the head acoustic transmission functions HL and HR appear in the both ears of the listener P. These additional notches decrease the effects of the notches formed in the acoustic signal Sin input to the sound image localization filter 11L as notches formed in the same bands as the bands of the first notch and the second notch of the head acoustic transmission function HR. Moreover, identification of the position of the virtual speaker 13 becomes difficult for the listener P, wherefore the position of the virtual speaker 13 in the up-down and front-rear directions becomes unstable.

Discussed hereinbelow is a specific example when the volume of the speaker 12R becomes significantly small with respect to the volume of the speaker 12L.

When the speaker 12L and the virtual speaker 13 are disposed on a circumference of an identical circle which is formed around an arbitrary point on an axis passing through the both ears of the listener P and is located perpendicular to this axis, or disposed in the vicinity of this circle, for example, a gain of the sound image localization filter 11R becomes significantly small in comparison with a gain of the sound image localization filter 11L.

Note that the axis passing through the both ears of the listener P is hereinafter referred to as an axis between both ears. In addition, the circle centered at the arbitrary point on the axis between both ears and perpendicular to the axis between both ears is hereinafter referred to as a circle around the axis between both ears. Note that identification between positions of sound sources located on the circumference of an identical circle around the axis between both ears is difficult for the listener P due to a phenomenon called cone-like mixture in the field of special acoustics (for example, see Non-patent Document 1, p. 16).

In this case, a difference between the both ears of the listener P in level and time of sound generated from the speaker 12L becomes substantially equivalent to a difference between the both ears of the listener P in level and time of sound generated from the virtual speaker 13. Accordingly, following formula (1) and formula (1') hold.

$$G2/G1 \approx HR/HL \quad (1)$$

$$HR \approx (G2*HL)/G1 \quad (1')$$

Note that the formula (1') is obtained by deforming the formula (1).

On the other hand, coefficients CL and CR of the typical sound image localization filters 11L and 11R are expressed by following formula (2-1) and formula (2-2).

$$CL=(G1*HL-G2*HR)/(G1*G1-G2*G2) \quad (2\text{-}1)$$

$$CR=(G1*HR-G2*HL)/(G1*G1-G2*G2) \quad (2\text{-}2)$$

Accordingly, following formula (3-1) and formula (3-2) hold on the basis of the formula (1'), the formula (2-1), and the formula (2-2).

$$CL \approx HL/G1 \quad (3\text{-}1)$$

$$CR \approx 0 \quad (3\text{-}2)$$

In this case, the sound image localization filter 11L becomes substantially equivalent to a difference between the head acoustic transmission function HL and the head acoustic transmission function G1. On the other hand, output from the sound image localization filter 11R becomes substantially zero. Accordingly, the volume of the speaker 12R becomes significantly small with respect to the volume of the speaker 12L.

Summarizing the above, the gain of the sound image localization filter 11R (coefficient CR) becomes significantly small in comparison with the gain of the sound image localization filter 11L (coefficient CL) when the speaker 12L and the virtual speaker 13 are disposed on the circumference of an identical circle around the axis between both ears, or in the vicinity of this circle. As a result, the volume of the speaker 12R becomes significantly small with respect to the volume of the speaker 12L, wherefore the position of the virtual speaker 13 in the up-down and front-rear directions becomes unstable. Note that a similar situation occurs when the speaker 12R and the virtual speaker 13 are disposed on the circumference of an identical circle around the axis between both ears, or in this vicinity of the circle.

On the other hand, the present technology is configured to stabilize a feeling of localization of a virtual speaker even when the volume of one of speakers becomes significantly small in comparison with the volume of the other speaker.

2. First Embodiment

An acoustic signal processing system according to a first embodiment to which the present technology has been applied is hereinafter described with reference to FIGS. 3 through 5.

Configuration Example of Acoustic Signal Processing System 101L

Figure 3:
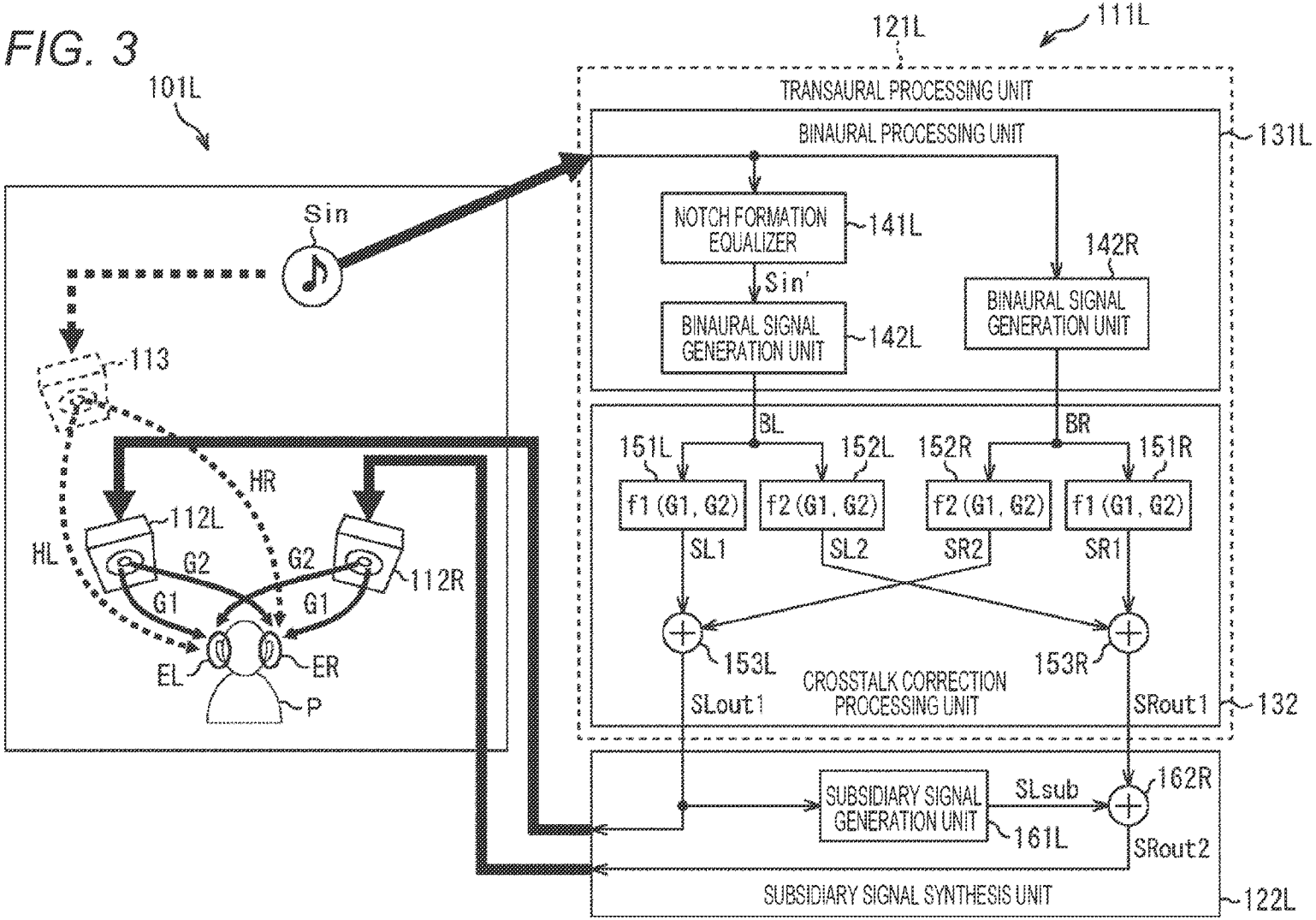
FIG. 3 is a view illustrating an acoustic signal processing system according to a first embodiment to which the present technology has been applied.

FIG. 3 is a view illustrating a configuration example of functions of an acoustic signal processing system 101L according to the first embodiment of the present technology.

The acoustic signal processing system 101L is configured to include an acoustic signal processing unit 111L, and speakers 112L and 112R. The speaker 112L and 112R are symmetrically disposed in the left-right direction in front of a predetermined ideal listening position in the acoustic signal processing system 101L, for example.

The acoustic signal processing system 101L realizes a virtual speaker 113 corresponding to a virtual sound source by using the speakers 112L and 112R. More specifically, the acoustic signal processing system 101L is capable of realizing localization of an image of sound output from the speakers 112L and 112R such that the sound is localized at a position of the virtual speaker 113 deviated leftward from a median plane of the listener P located at the predetermined listening position.

Note that hereinafter described is a case when the position of the virtual speaker 113 is set at a diagonally upper left position in front of the listening position (listener P). In this case, the right ear ER of the listener P is located on the shadow side. Further described hereinafter is a case when the speaker 112L and the virtual speaker 113 are disposed on a circumference of an identical circle around an axis between both ears, or in the vicinity of this circle.

In addition, similarly to the example illustrated in FIG. 2, a sound source side HRTF between the virtual speaker 113 and the left ear EL of the listener P is hereinafter referred to as a head acoustic transmission function HL, while a sound source opposite side HRTF between the virtual speaker 113 and the right ear ER of the listener P is hereinafter referred to as a head acoustic transmission function HR. Moreover, similarly to the example illustrated in FIG. 2, it is assumed hereinbelow that an HRTF between the speaker 112L and the left ear EL of the listener P is equivalent to an HRTF between the speaker 112R and the right ear ER of the listener P. The corresponding HRTF is referred to as a head acoustic transmission function G1. Furthermore, similarly to the example illustrated in FIG. 2, it is assumed hereinbelow that an HRTF between the speaker 112L and the right ear ER of the listener P is equivalent to an HRTF between the speaker 112R and the left ear EL of the listener P. The corresponding HRTF is referred to as a head acoustic transmission function G2.

The acoustic signal processing unit 111L is configured to include a transaural processing unit 121L and a subsidiary signal synthesis unit 122L. The transaural processing unit 121L is configured to include a binaural processing unit 131L and a crosstalk correction processing unit 132. The binaural processing unit 131L is configured to include a notch formation equalizer 141L, and binaural signal generation units 142L and 142R. The crosstalk correction processing unit 132 is configured to include signal processing units 151L and 151R, signal processing units 152L and 152R, and addition units 153L and 153R. The subsidiary signal synthesis unit 122L is configured to include a subsidiary signal generation unit 161L and an addition unit 162R.

The notch formation equalizer 141L performs a process for attenuating components in an acoustic signal Sin input from the outside, which components are contained in bands of appearance of a first notch and a second notch in the sound source opposite side HRTF (head acoustic transmission function HR) (hereinafter referred to as notch formation process). The notch formation equalizer 141L supplies an acoustic signal Sin' obtained by the notch formation process to the binaural signal generation unit 142L.

The binaural signal generation unit 142L superimposes the head acoustic transmission function HL on the acoustic signal Sin' to generate a binaural signal BL. The binaural signal generation unit 142L supplies the generated binaural signal BL to the signal processing unit 151L and the signal processing unit 152L.

The binaural signal generation unit 142R superimposes the head acoustic transmission function HR on the acoustic signal Sin output from the outside to generate a binaural signal BR. The binaural signal generation unit 142R supplies the generated binaural signal BR to the signal processing unit 151R and the signal processing unit 152R. The signal processing unit 151L superimposes a predetermined function f1(G1, G2) having variables of the head acoustic transmission functions G1 and G2 on the binaural signal BL to generate an acoustic signal SL1. The signal processing unit 151L supplies the generated acoustic signal SL1 to the addition unit 153L.

Similarly, the signal processing unit 151R superimposes the function f1(G1, G2) on the binaural signal BR to generate an acoustic signal SR1. The signal processing unit 151R supplies the generated acoustic signal SR1 to the addition unit 153R.

Note that the function f1(G1, G2) is expressed by a following formula (4), for example.

$$f1(G1,G2)=1/(G1+G2)+1/(G1-G2) \tag{4}$$

The signal processing unit 152L superimposes a predetermined function f2(G1, G2) having variables of the head acoustic transmission functions G1 and G2 on the binaural signal BL to generate an acoustic signal SL2. The signal processing unit 152L supplies the generated acoustic signal SL2 to the addition unit 153R.

Similarly, the signal processing unit 152R superimposes the function f2(G1, G2) on the binaural signal BR to generate an acoustic signal SR2. The signal processing unit 152R supplies the generated acoustic signal SR2 to the addition unit 153L. Note that the function f2(G1, G2) is expressed by a following formula (5), for example.

$$f2(G1,G2)=1/(G1+G2)-1/(G1-G2) \tag{5}$$

The addition unit 153L adds the acoustic signal SL1 and the acoustic signal SR2 to generate an acoustic signal SLout1. The addition unit 153L supplies the acoustic signal SLout1 to the subsidiary signal generation unit 161L and the speaker 112L.

The addition unit 153R adds the acoustic signal SR1 and the acoustic signal SL2 to generate an acoustic signal SRout1. The addition unit 153R supplies the acoustic signal SRout1 to the addition unit 162R.

The subsidiary signal generation unit 161L is constituted by a filter for extracting or attenuating a signal in a predetermined band (such as high-pass filter and band-pass filter), and an attenuator for adjusting a signal level, for example. The subsidiary signal generation unit 161L extracts or attenuates a signal in a predetermined band of the acoustic signal SLout1 to generate a subsidiary signal SLsub, and adjusts a signal level of the subsidiary signal SLsub as necessary. The subsidiary signal generation unit 161L supplies the generated subsidiary signal SLsub to the addition unit 162R.

The addition unit 162R adds the acoustic signal SRout1 and the subsidiary signal SLsub to generate an acoustic signal SRout2. The addition unit 162R supplies the acoustic signal SRout2 to the speaker 112R.

The speaker 112L outputs sound based on the acoustic signal SLout1, while the speaker 112R outputs sound based on the acoustic signal SRout2 (i.e., synthesis signal of acoustic signal SRout1 and subsidiary signal SLsub).

{Acoustic Signal Processing by Acoustic Signal Processing System 101L}

An acoustic signal process performed by the acoustic signal processing system 101L illustrated in FIG. 3 is now described with reference to a flowchart shown in FIG. 4.

In step S1, the notch formation equalizer 141L forms notches in the sound source side acoustic signal Sin in the same bands as the bands of notches of the sound source opposite side HRTF. More specifically, the notch formation equalizer 141L attenuates components in the acoustic signal Sin in the same bands as the bands of the first notch and the second notch in the head acoustic transmission function HR corresponding to the sound source opposite side HRTF of the virtual speaker 113. This step attenuates components in the acoustic signal Sin in the lowest band and the second lowest band in a range equal to or higher than a predetermined frequency (frequency around 4 kHz at which a positive peak appears) in the bands of appearance of the notches of the head acoustic transmission function HR. Then, the notch formation equalizer 141L supplies the acoustic signal Sin' thus obtained to the binaural signal generation unit 142L.

In step S2, the binaural signal generation units 142L and 142R perform the binaural process. More specifically, the binaural signal generation unit 142L superimposes the head acoustic transmission function HL on the acoustic signal Sin' to generate the binaural signal BL. The binaural signal generation unit 142L supplies the generated binaural signal BL to the signal processing unit 151L and the signal processing unit 152L.

The binaural signal BL is a signal generated by superimposing an HRTF on the acoustic signal Sin. This HRFT contains notches in the sound source side HRTF (head acoustic transmission function HL) in the same bands as the bands of the first notch and the second notch of the sound source opposite side HRTF (head acoustic transmission function HR). In other words, the binaural signal BL is a signal which attenuates components in the acoustic signal Sin on which the sound source side HRTF is superimposed, which components are contained in the bands of appearance of the first notch and the second notch of the sound source opposite side HRTF.

On the other hand, the binaural signal generation unit 142R superimposes the head acoustic transmission function HR on the acoustic signal Sin to generate the binaural signal BR. The binaural signal generation unit 142R supplies the generated binaural signal BR to the signal processing unit 151R and the signal processing unit 152R.

In step S3, the crosstalk correction processing unit 132 performs a correction process. More specifically, the signal processing unit 151L superimposes the foregoing function f1(G1, G2) on the binaural signal BL to generate the acoustic signal SL1. The signal processing unit 151L supplies the generated acoustic signal SL1 to the addition unit 153L.

Similarly, the signal processing unit 151R superimposes the function f1(G1, G2) on the binaural signal BR to generate the acoustic signal SR1. The signal processing unit 151R supplies the generated acoustic signal SR1 to the addition unit 153R.

Moreover, the signal processing unit 152L superimposes the foregoing function f2(G1, G2) on the binaural signal BL to generate the acoustic signal SL2. The signal processing unit 152L supplies the generated acoustic signal SL2 to the addition unit 153R.

Similarly, the signal processing unit 152R superimposes the function f2(G1, G2) on the binaural signal BR to generate the acoustic signal SR2. The signal processing unit 152R supplies the generated acoustic signal SL2 to the addition unit 153L.

The addition unit 153L adds the acoustic signal SL1 and the acoustic signal SR2 to generate the acoustic signal SLout1. The addition unit 153L supplies the generated acoustic signal SLout1 to the subsidiary signal generation unit 161L and the speaker 112L.

Similarly, the addition unit 153R adds the acoustic signal SR1 and the acoustic signal SL2 to generate the acoustic signal SRout1. The addition unit 153R supplies the generated acoustic signal SRout1 to the addition unit 162R.

As described above, the speaker 112L and the virtual speaker 113 herein are disposed on the circumference of the identical circle around the axis between both ears, or in the vicinity of this circle. Accordingly, the level of the acoustic signal SRout1 becomes substantially zero.

In step S4, the subsidiary signal synthesis unit 122L performs a subsidiary signal synthesis process. More specifically, the subsidiary signal generation unit 161L extracts or attenuates a signal in a predetermined band of the acoustic signal SLout1 to generate the subsidiary signal SLsub.

For example, the subsidiary signal generation unit 161L attenuates the acoustic signal SLout1 in a band lower than 4 kHz to generate the subsidiary signal SLsub constituted by a component of the acoustic signal SLout1 in a band equal to or higher than 4 kHz.

Alternatively, the subsidiary signal generation unit 161L extracts a component in a predetermined band from a range of bands equal to or higher than 4 kHz of the acoustic signal SLout1, for example, to generate the subsidiary signal SLsub. The band to be extracted herein at least includes the bands of appearance of the first notch and the second notch of the head acoustic transmission function G1, and the bands of appearance of the first notch and the second notch of the head acoustic transmission function G2.

Note that the band of the subsidiary signal SLsub at least includes the bands of appearance of the first notch and the second notch of each HRTF in case that the HRTF between the speaker 112L and the left ear EL is different from the HRTF between the speaker 112R and the right ear ER, and that the HRTF between the speaker 112L and the right ear ER is different from the HRTF between the speaker 112R and the left ear EL.

The subsidiary signal generation unit 161L further adjusts the signal level of the subsidiary signal SLsub as necessary. Then, the subsidiary signal generation unit 161L supplies the generated subsidiary signal SLsub to the addition unit 162R.

The addition unit 162R adds the subsidiary signal SLsub to the acoustic signal SRout1 to generate the acoustic signal SRout2. The addition unit 162R supplies the generated acoustic signal SRout2 to the speaker 112R.

As a result, the level of the acoustic signal SRout2 becomes a significant level with respect to the acoustic signal SLout1 at least in the bands of appearance of the first notch and the second notch of the head acoustic transmission function G1, and in the bands of appearance of the first notch and the second notch of the head acoustic transmission function G2 even when the level of the acoustic signal SRout1 is substantially zero. On the other hand, the level of the acoustic signal SRout2 becomes extremely low in the bands of appearance of the first notch and the second notch of the head acoustic transmission function HR.

In step S4, sound based on the acoustic signal SLout1 and sound based on the acoustic signal SRout2 are output from the speaker 112L and the speaker 112R, respectively.

In this case, the signal levels of reproduced sound from the speaker 112L and 112R decrease when attention is paid only to the bands of the first notch and the second notch of the sound source opposite side HRTF (head acoustic transmission function HR). As a result, sound in the corresponding bands is stabilized at a low level when reaching the both ears of the listener P. Accordingly, the first notch and the second notch of the sound source opposite side HRTF are reproduced in a stable manner in the vicinity of the shadow side ear of the listener P even when a crosstalk occurs.

In addition, each level of sound output from the speaker 112L and sound output from the speaker 112R becomes significant in the bands of appearance of the first notch and the second notch of the head acoustic transmission function G1 and in the bands of the first notch and the second notch of the head acoustic transmission function G2. In this case, the first notch and the second notch of the head acoustic transmission function G1 and the first notch and the second notch of the head acoustic transmission function G2 cancel each other in the both ears of the listener P, wherefore the respective notches disappear.

Accordingly, even when the speaker 112L and the virtual speaker 113 are disposed on the circumference of the identical circle around the axis between both ears, or in the vicinity of this circle in a state of a significantly low level of the acoustic signal SRout1 in comparison with the acoustic signal SLout1, the position of the virtual speaker 113 in the up-down and front-rear directions is stabilized.

Note that there may be a slight expansion of the size of the sound image in the band of the subsidiary signal SLsub by an effect of the subsidiary signal SLsub. However, a sound body is basically produced in ranges from a low range to a middle range. Accordingly, the effect of the expansion of the subsidiary signal SLsub is small when the subsidiary signal SLsub has an appropriate level. It is preferable, however, that the level of the subsidiary signal SLsub is reduced to the minimum within a range of the effect for stabilizing localization of the virtual speaker 113.

Modified Example of First Embodiment

Figure 5:
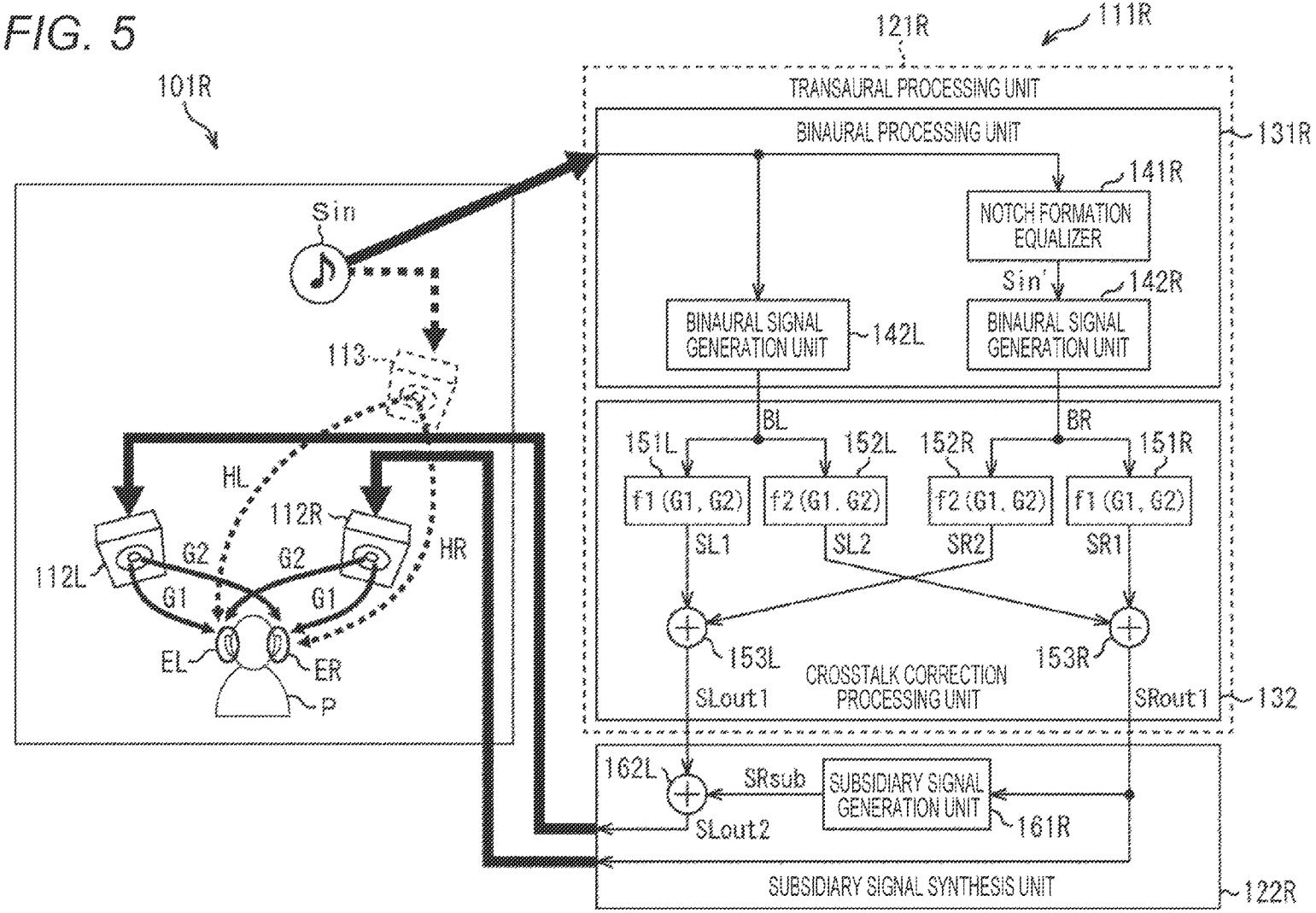
FIG. 5 is a view illustrating a modified example of the acoustic signal processing system according to the first embodiment to which the present technology has been applied.

FIG. 5 is a view illustrating a configuration example of functions of an acoustic signal processing system 101R according to a modified example of the first embodiment of the present technology. Note that parts in the figure similar to the corresponding parts in FIG. 3 are given similar reference numbers. Repetitive description of similar processing parts is omitted where appropriate.

The acoustic signal processing system 101R is a system which localizes the virtual speaker 113 at a position deviated rightward from a median plane of the listener P located at a predetermined listening position, contrary to the acoustic signal processing system 101L. In this case, the left ear EL of the listener P is located on the shadow side.

The acoustic signal processing system 101R and the acoustic signal processing system 101L have symmetric structures in the left-right direction. More specifically, the acoustic signal processing system 101R is different from the acoustic signal processing system 101L in that an acoustic signal processing unit 111R is provided in place of the acoustic signal processing unit 111L. The acoustic signal processing unit 111R is different from the acoustic signal processing unit 111L in that a transaural processing unit 121R and a subsidiary signal synthesis unit 122R are provided in place of the transaural processing unit 121L and the subsidiary signal synthesis unit 122L. The transaural processing unit 121R is different from the transaural processing unit 121L in that a binaural processing unit 131R is provided in place of the binaural processing unit 131L.

The binaural processing unit 131R is different from the binaural processing unit 131L in that a notch formation equalizer 141R is provided on the upstream side of the binaural signal generation unit 142R, and that the notch formation equalizer 141L is eliminated.

The notch formation equalizer 141R has a function similar to the function of the notch formation equalizer 141L, and performs a notch formation process for attenuating components of an acoustic signal Sin in bands of appearance of a first notch and a second notch of a sound source opposite side HRTF (head acoustic transmission function HL). The notch formation equalizer 141R supplies an acoustic signal Sin' thus obtained to the binaural signal generation unit 142R.

The binaural signal generation unit 142L superimposes the head acoustic transmission function HL on the acoustic signal Sin input from the outside to generate a binaural signal BL. The binaural signal generation unit 142L supplies the generated binaural signal BL to the signal processing unit 151L and the signal processing unit 152L.

The binaural signal generation unit 142R superimposes a head acoustic transmission function HR on the acoustic signal Sin' to generate a binaural signal BR. The binaural signal generation unit 142R supplies the generated binaural signal BR to the signal processing unit 151R and the signal processing unit 152R.

The subsidiary signal synthesis unit 122R is different from the subsidiary signal synthesis unit 122L in that a subsidiary signal generation unit 161R and an addition unit 162L are provided in place of the subsidiary signal generation unit 161L and the addition unit 162R.

The subsidiary signal generation unit 161R has a function similar to the function of the subsidiary signal generation unit 161L. The subsidiary signal generation unit 161R extracts or attenuates a signal in a predetermined band of an acoustic signal SRout1 to generate a subsidiary signal SRsub, and adjusts the signal level of the subsidiary signal SRsub as necessary. The subsidiary signal generation unit 161R supplies the generated subsidiary signal SRsub to the addition unit 162L.

The addition unit 162L adds an acoustic signal SLout1 and the subsidiary signal SRsub to generate an acoustic signal SLout2. The addition unit 162L supplies the acoustic signal SLout2 to the speaker 112L.

Thereafter, the speaker 112L outputs sound based on the acoustic signal SLout2, while the speaker 112R outputs sound based on the acoustic signal SRout1.

As a result, the virtual speaker 113 of the acoustic signal processing system 101R is localized in a stable manner at a position deviated rightward from the median plane of the listener P located at the predetermined listening position by a method similar to the method of the acoustic signal processing system 101L.

3. Second Embodiment

An acoustic signal processing system according to a second embodiment to which the present technology has been applied is now described with reference to FIGS. 6 through 8.

Configuration Example of Acoustic Signal Processing System 201L

Figure 6:
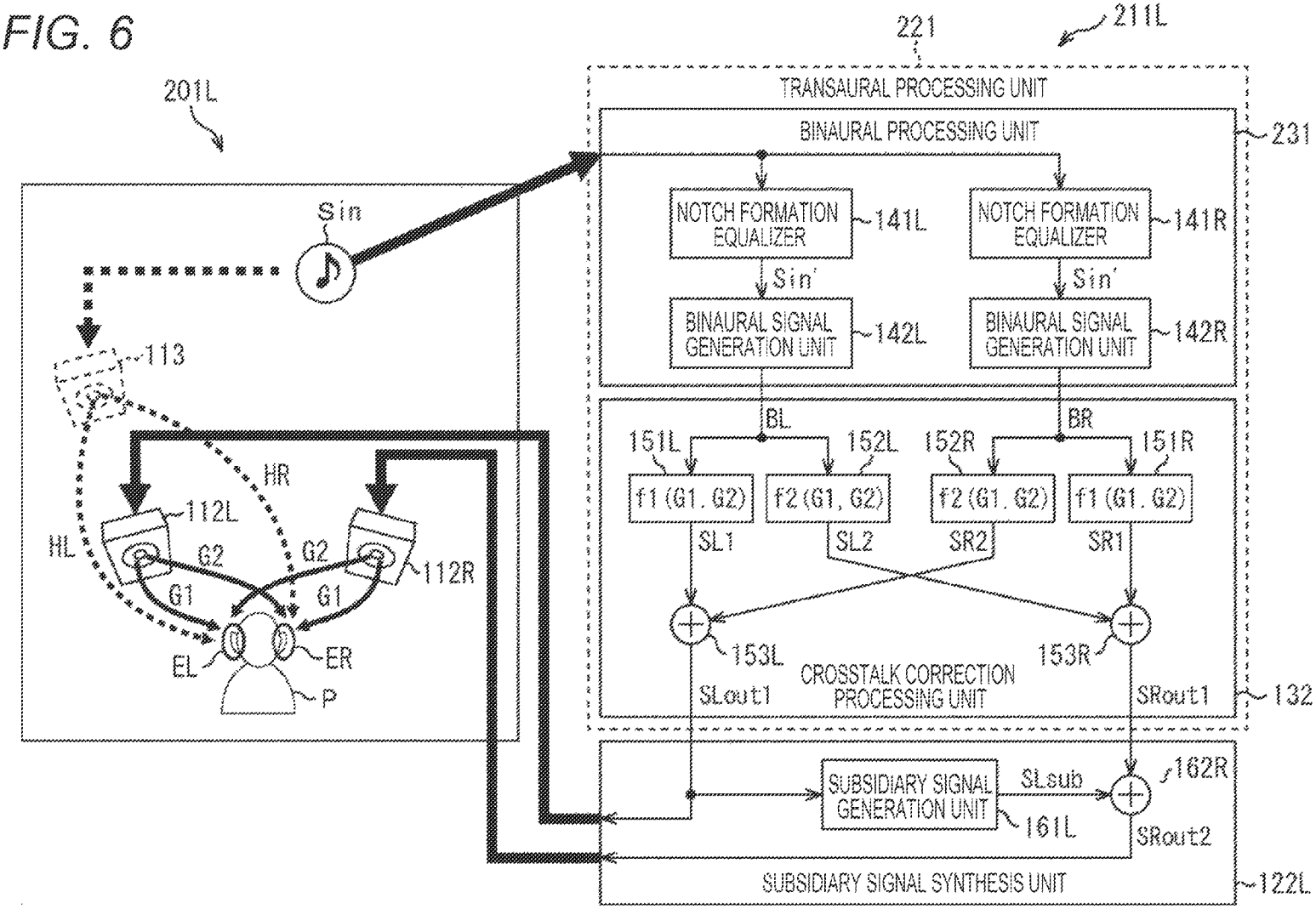
FIG. 6 is a view illustrating an acoustic signal processing system according to a second embodiment to which the present technology has been applied.
Figure 7:
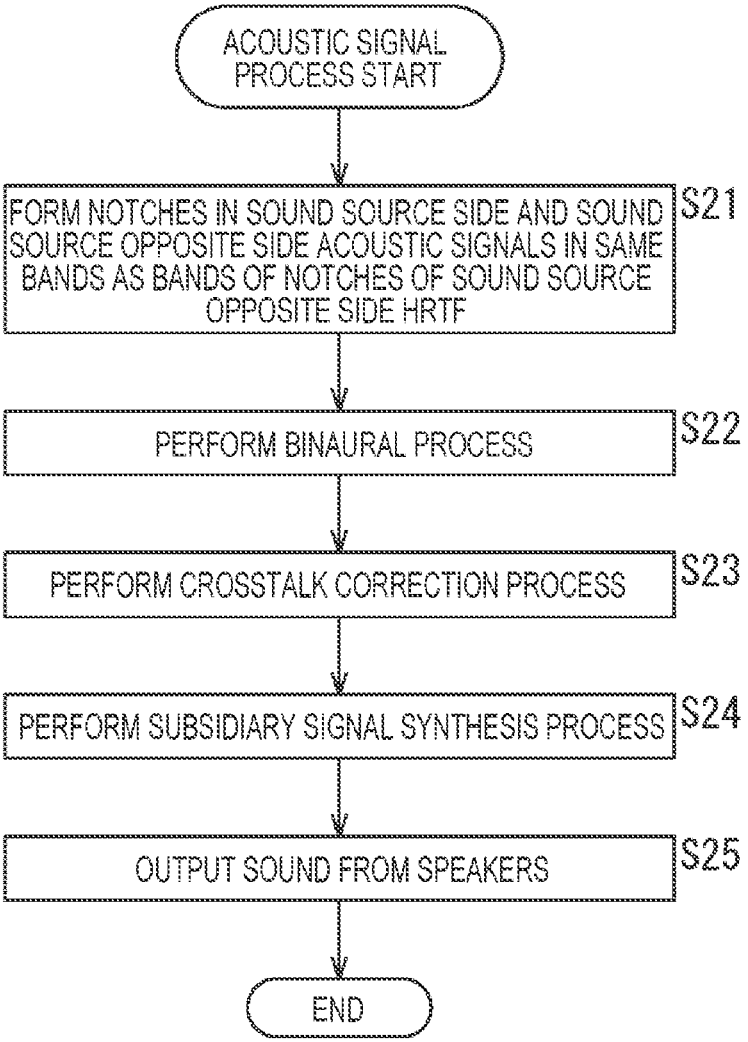
FIG. 7 is a flowchart describing an acoustic signal process performed by the acoustic signal processing system according to the second embodiment.

FIG. 6 is a view illustrating a configuration example of functions of an acoustic signal processing system 201L according to the second embodiment of the present technology. Note that parts in the figure similar to the corresponding parts in FIG. 3 are given similar reference numbers. Repetitive description of similar processing parts is omitted where appropriate.

The acoustic signal processing system 201L is a system capable of localizing the virtual speaker 113 at a position deviated leftward from a median plane of the listener P located at a predetermined listening position, similarly to the acoustic signal processing system 101L.

The acoustic signal processing system 201L is different from the acoustic signal processing system 101L illustrated in FIG. 3 in that an acoustic signal processing unit 211L is provided in place of the acoustic signal processing unit 111L. The acoustic signal processing unit 211L is different from the acoustic signal processing unit 111L in that a transaural processing unit 221 is provided in place of the transaural processing unit 121L. The transaural processing unit 221 is different from the transaural processing unit 121L in that a binaural processing unit 231 is provided in place of the binaural processing unit 131L. The binaural processing unit 231 is different from the binaural processing unit 131L in that the notch formation equalizer 141R is added on the upstream side of the binaural signal generation unit 142R.

The notch formation equalizer 141R is an equalizer similar to the notch formation equalizer 141L. Accordingly, the notch formation equalizer 141R performs a notch formation process for attenuating components of an acoustic signal Sin in bands of appearance of a first notch and a second notch in a sound source opposite side HRTF (head acoustic transmission function HR). The notch formation equalizer 141L supplies an acoustic signal Sin' obtained by the notch formation process to the binaural signal generation unit 142R.

{Acoustic Signal Process by Acoustic Signal Processing System 201L}

An acoustic signal process performed by the acoustic signal processing system 201L illustrated in FIG. 6 is now described with reference to a flowchart shown in FIG. 7.

In step S21, the notch formation equalizers 141L and 141R form notches in the sound source side and sound source opposite side acoustic signals Sin in the same bands as the bands of the notches of the sound source opposite side HRTF. More specifically, the notch formation equalizer 141L attenuates components in the acoustic signal Sin in the same bands as the bands of the first notch and the second notch in the head acoustic transmission function HR corresponding to the sound source opposite side HRTF of the virtual speaker 113. Then, the notch formation equalizer 141L supplies the acoustic signal Sin' thus obtained to the binaural signal generation unit 142L.

Similarly, the notch formation equalizer 141R attenuates components in the acoustic signal Sin in the same bands as the bands of the first notch and the second notch of the head acoustic transmission function HR. Thereafter, the notch formation equalizer 141R supplies the acoustic signal Sin' thus obtained to the binaural signal generation unit 142R.

In step S22, the binaural signal generation units 142L and 142R perform a binaural process. More specifically, the binaural signal generation unit 142L superimposes the head acoustic transmission function HL on the acoustic signal Sin' to generate a binaural signal BL. The binaural signal generation unit 142L supplies the generated binaural signal BL to the signal processing unit 151L and the signal processing unit 152L.

Similarly, the binaural signal generation unit 142R superimposes the head acoustic transmission function HR on the acoustic signal Sin' to generate a binaural signal BR. The binaural signal generation unit 142R supplies the generated binaural signal BR to the signal processing unit 151R and the signal processing unit 152R.

The binaural signal BR is a signal generated by superimposing an HRTF on the acoustic signal Sin. This HRTF contains notches formed by substantially deepening the first notch and the second notch of the sound source opposite side HRTF (head acoustic transmission function HR). Accordingly, the components in the bands of appearance of the first notch and the second notch in the sound source opposite side HRTF in the binaural signal BR thus generated become smaller in comparison with the corresponding components of the binaural signal BR of the acoustic signal processing system 101L.

Figure 4:
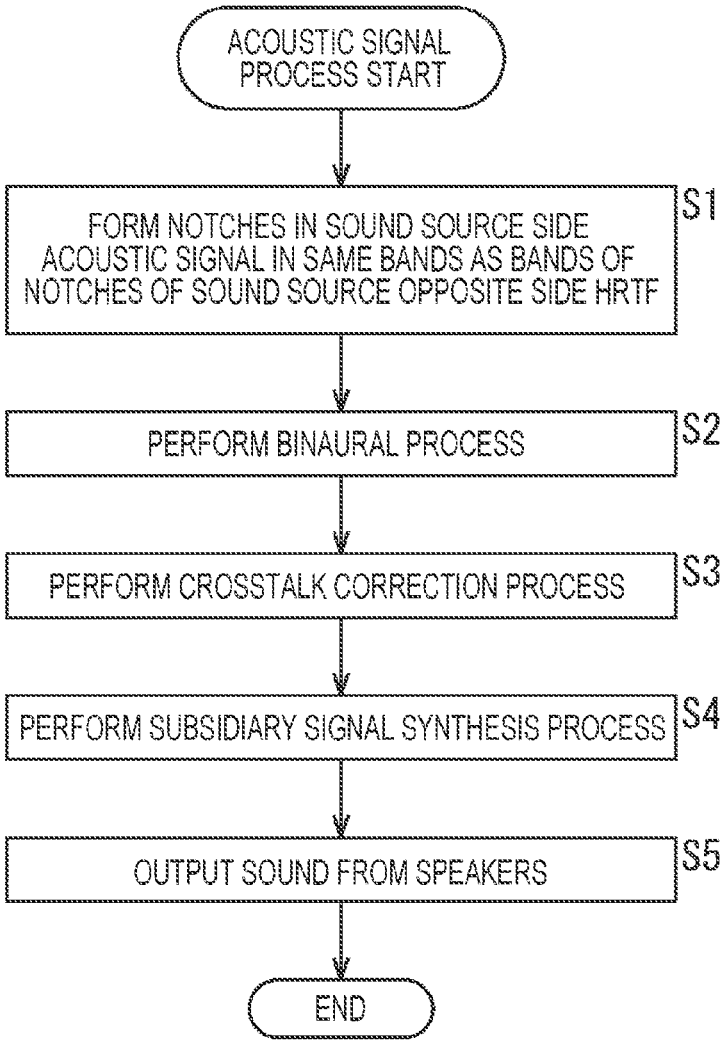
FIG. 4 is a flowchart describing an acoustic signal process performed by the acoustic signal processing system according to the first embodiment.

Thereafter, processing similar to the processing in steps S3 through S5 in FIG. 4 is performed in steps S23 through S25. The acoustic signal process ends after completion of these steps.

Accordingly, a feeling of localization of the virtual speaker 113 in the up-down and front-rear directions is also stabilized in the acoustic signal processing system 201L for reasons similar to the corresponding reasons of the acoustic signal processing system 101L.

Note that the components in the bands of appearance of the first notch and the second notch of the sound source opposite side HRTF (head acoustic transmission function HR) of the binaural signal BR in the acoustic signal processing system 201L become small in comparison with the corresponding components of the acoustic signal processing system 101L, as described above. Accordingly, the components in the same bands of the acoustic signal SRout2 finally supplied to the speaker 112R also become smaller, wherefore the level in the same bands of sound output from the speaker 112R decreases.

However, this condition does not have an adverse effect on stable reproduction of the levels of the bands of the first notch and the second notch of the sound source opposite side HRTF in the vicinity of the shadow side ear of the listener P. Accordingly, the acoustic signal processing system 201L offers an advantageous effect of stabilizing a feeling of localization in the up-down and front-rear directions, similarly to the acoustic signal processing system 101L.

Moreover, sound in the bands of the first notch and the second notch of the sound source opposite side HRTF originally has a low level when reaching the both ears of the listener P. Accordingly, a further drop of this level does not adversely affect sound quality.

Modified Example of Second Embodiment

Figure 8:
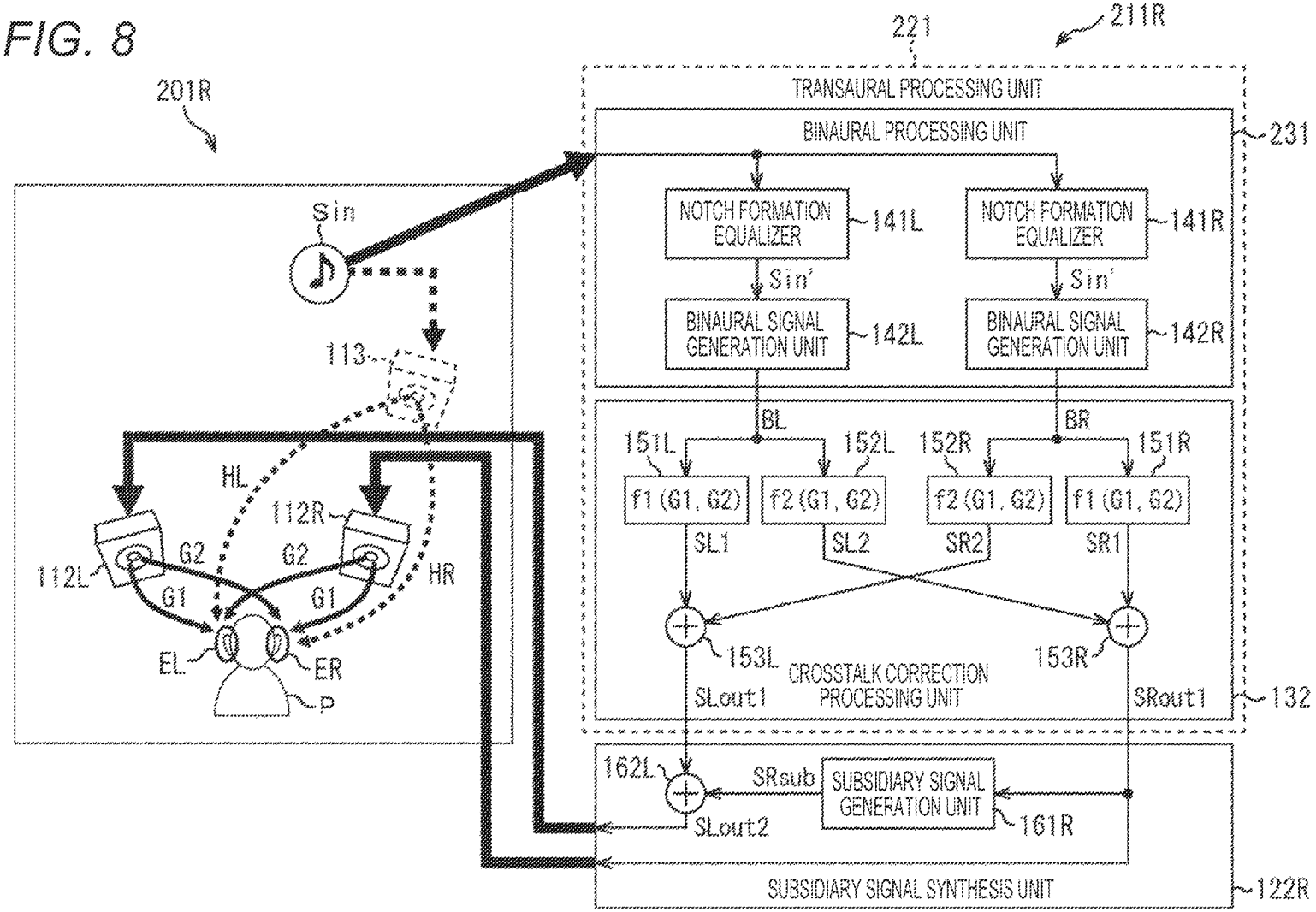
FIG. 8 is a view illustrating a modified example of the acoustic signal processing system according to the second embodiment to which the present technology has been applied.

FIG. 8 is a view illustrating a configuration example of functions of an acoustic signal processing system 201R according to a modified example of the second embodiment of the present technology. Note that parts in the figure similar to the corresponding parts in FIGS. 5 and 6 are given similar reference numbers. Repetitive description of similar processing parts is omitted where appropriate.

The acoustic signal processing system 201R is different from the acoustic signal processing system 201L illustrated in FIG. 6 in that the subsidiary signal synthesis unit 122R described above with reference to FIG. 5 is provided in place of the subsidiary signal synthesis unit 122L.

Accordingly, the acoustic signal processing system 201R is capable of localizing the virtual speaker 113 in a stable manner at a position deviated rightward from a median plane of the listener P by a method similar to the method of the acoustic signal processing system 201L.

4. Third Embodiment

An acoustic signal processing system 301L according to a third embodiment to which the present technology has been adopted is now described with reference to FIGS. 9 through 11.

Configuration Example of Acoustic Signal Processing System 301L

Figure 9:
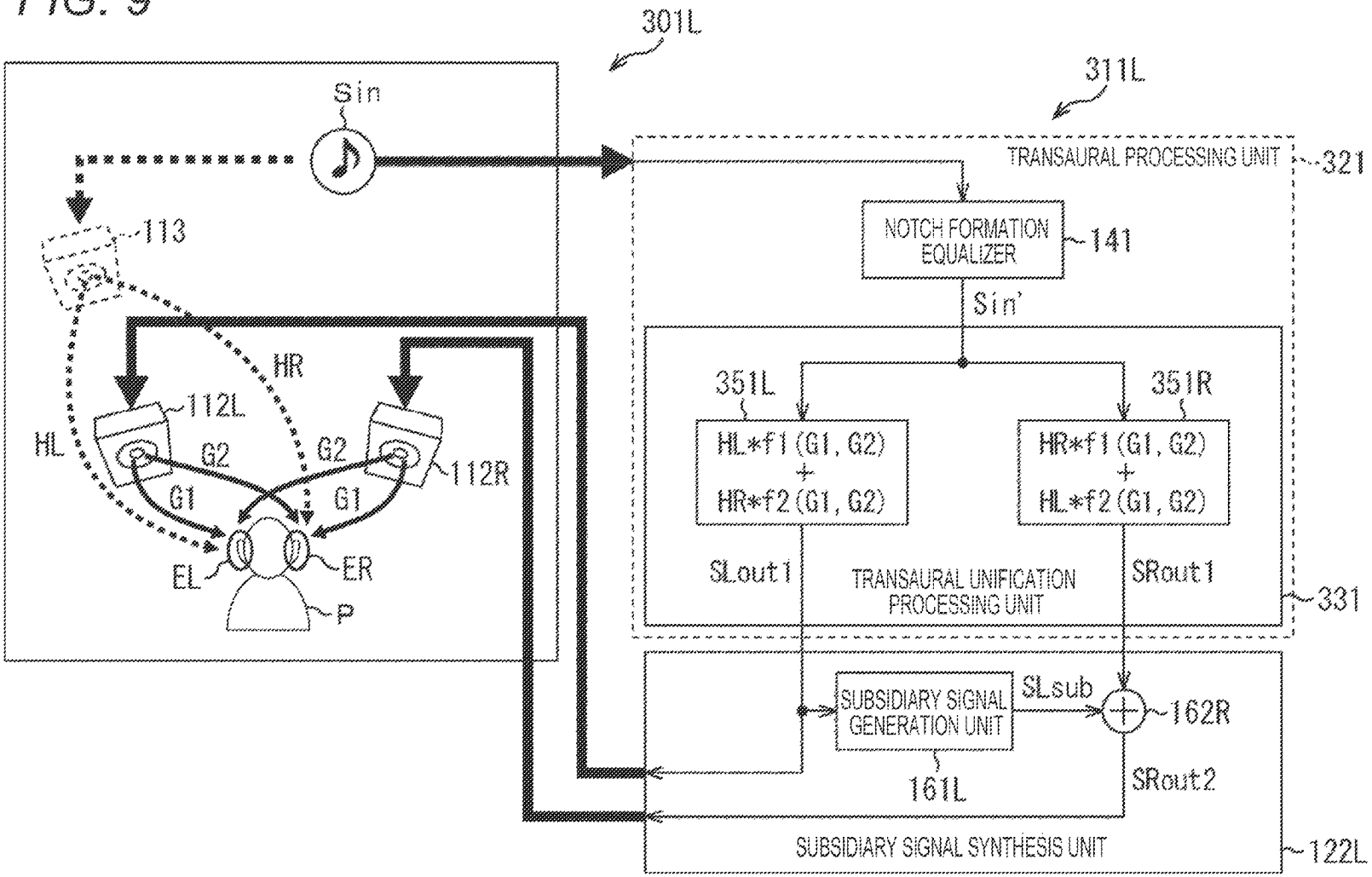
FIG. 9 is a view illustrating an acoustic signal processing system according to a third embodiment to which the present technology has been applied.
Figure 10:
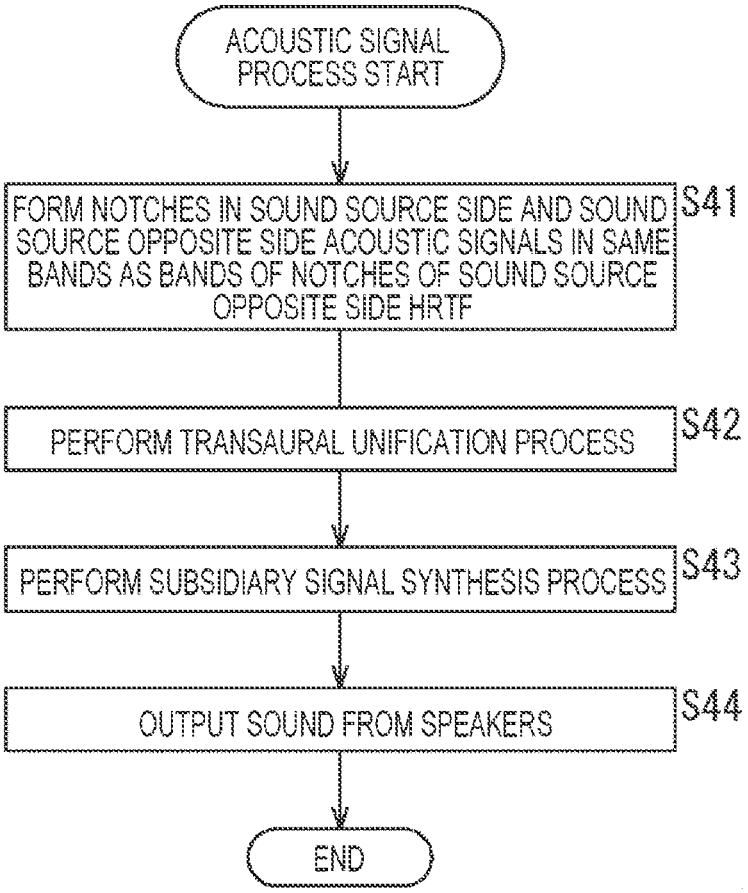
FIG. 10 is a flowchart describing an acoustic signal process performed by the acoustic signal processing system according to the third embodiment.

FIG. 9 is a view illustrating a configuration example of functions of an acoustic signal processing system 301L according to the third embodiment of the present technology. Note that parts in the figure similar to the corresponding parts in FIG. 6 are given similar reference numbers. Repetitive description of similar processing parts is omitted where appropriate.

The acoustic signal processing system 301L is a system capable of localizing the virtual speaker 113 at a position deviated leftward from a median plane of the listener P located at a predetermined listening position, similarly to the acoustic signal processing systems 101L and 201L.

The acoustic signal processing system 301L is different from the acoustic signal processing system 201L illustrated in FIG. 6 in that the acoustic signal processing unit 311L is provided in place of the acoustic signal processing unit 211L. The acoustic signal processing unit 311L is different from the acoustic signal processing unit 211L in that a transaural processing unit 321 is provided in place of the transaural processing unit 221. The transaural processing unit 321 is configured to include a notch formation equalizer 141 and a transaural unification processing unit 331. The transaural unification processing unit 331 is configured to include signal processing units 351L and 351R.

The notch formation equalizer 141 is an equalizer similar to the notch formation equalizers 141L and 141R illustrated in FIG. 9. Accordingly, an acoustic signal Sin' similar to the acoustic signal Sin of the notch formation equalizers 141L and 141R is output from the notch formation equalizer 141, and supplied to the signal processing units 351L and 351R.

The transaural unification processing unit 331 performs a unification process for unifying the binaural process and the crosstalk correction process for the acoustic signal Sin'. For example, the signal processing unit 351L performs a process expressed by a following formula (6) for the acoustic signal Sin' to generate an acoustic signal SLout1.

$$SLout1=\{HL1*f1(G1,G2)+HR*f2(G1,G2)\}\times Sin' \quad (6)$$

The acoustic signal SLout1 is the same signal as the acoustic signal SLout1 of the acoustic signal processing system 201L.

Similarly, the signal processing unit 351R performs a process expressed by a following formula (7) for the acoustic signal Sin' to generate an acoustic signal SRout1, for example.

$$SRout1=\{HR*f1(G1,G2)+HL*f2(G1,G2)\}\times Sin' \quad (7)$$

The acoustic signal SRout1 is the same signal as the acoustic signal SRout1 of the acoustic signal processing system 201L.

Note that there exists no route performing the notch formation process only for a sound source side acoustic signal Sin when the notch formation equalizer 141 is mounted outside the signal processing units 351L and 351R. Accordingly, the acoustic signal processing unit 311L includes a notch formation equalizer 141 on the upstream side of the signal processing unit 351L and the signal processing unit 351R to perform the notch formation process for both the sound source side and sound source opposite side acoustic signals Sin, and supply the processed acoustic signals Sin to the signal processing units 351L and 351R. More specifically, an HRTF which contains notches formed by substantially deepening the first notch and the second notch of the sound source opposite side HRTF is superimposed on the sound source opposite side acoustic signal Sin, similarly to the acoustic signal processing system 201L.

However, as described above, a feeling of localization in the up-down and front-rear directions, and sound quality are not adversely affected even when the first notch and the second notch of the sound source opposite side HRTF are further deepened.

{Acoustic Signal Process by Acoustic Signal Processing System 301L}

An acoustic signal process performed by the acoustic signal processing system 301L illustrated in FIG. 9 is now described with reference to a flowchart shown in FIG. 10.

In step S41, the notch formation equalizer 141 forms notches in the sound source side and sound source opposite side acoustic signals Sin in the same bands as the bands of the notches of the sound source opposite side HRTF. More specifically, the notch formation equalizer 141 attenuates components in the acoustic signals Sin in the same bands as the bands of the first notch and the second notch of the sound source opposite side HRTF (head acoustic transmission function HR). The notch formation equalizer 141 supplies the acoustic signal Sin' thus obtained to the signal processing units 351L and 351R.

In step S42, the transaural unification processing unit 331 performs a transaural unification process. More specifically, the signal processing unit 351L performs the unification process for unifying the binaural process and the crosstalk correction process as expressed by the foregoing formula (6) for the acoustic signal Sin' to generate an acoustic signal SLout1. Then, the signal processing unit 351L supplies the acoustic signal SLout1 to the speaker 112L and the subsidiary signal generation unit 161L. Similarly, the signal processing unit 351R performs the unification process for unifying the binaural process and the crosstalk process as expressed by the foregoing formula (7) for the acoustic signal Sin' to generate an acoustic signal SRout1. Then, the signal processing unit 351R supplies the acoustic signal SRout1 to the addition unit 162R.

In steps S43 and S44, processing similar to the processing in steps S4 and S5 shown in FIG. 4 is performed, whereafter the acoustic signal process ends.

Accordingly, the acoustic signal processing system 301L is capable of stabilizing a feeling of localization of the virtual speaker 113 in the up-down and front-rear directions for reasons similar to the reasons of the acoustic signal processing system 201L. In addition, reduction of a signal processing load is generally expected in comparison with the acoustic signal processing system 201L.

Modified Example of Third Embodiment

Figure 11:
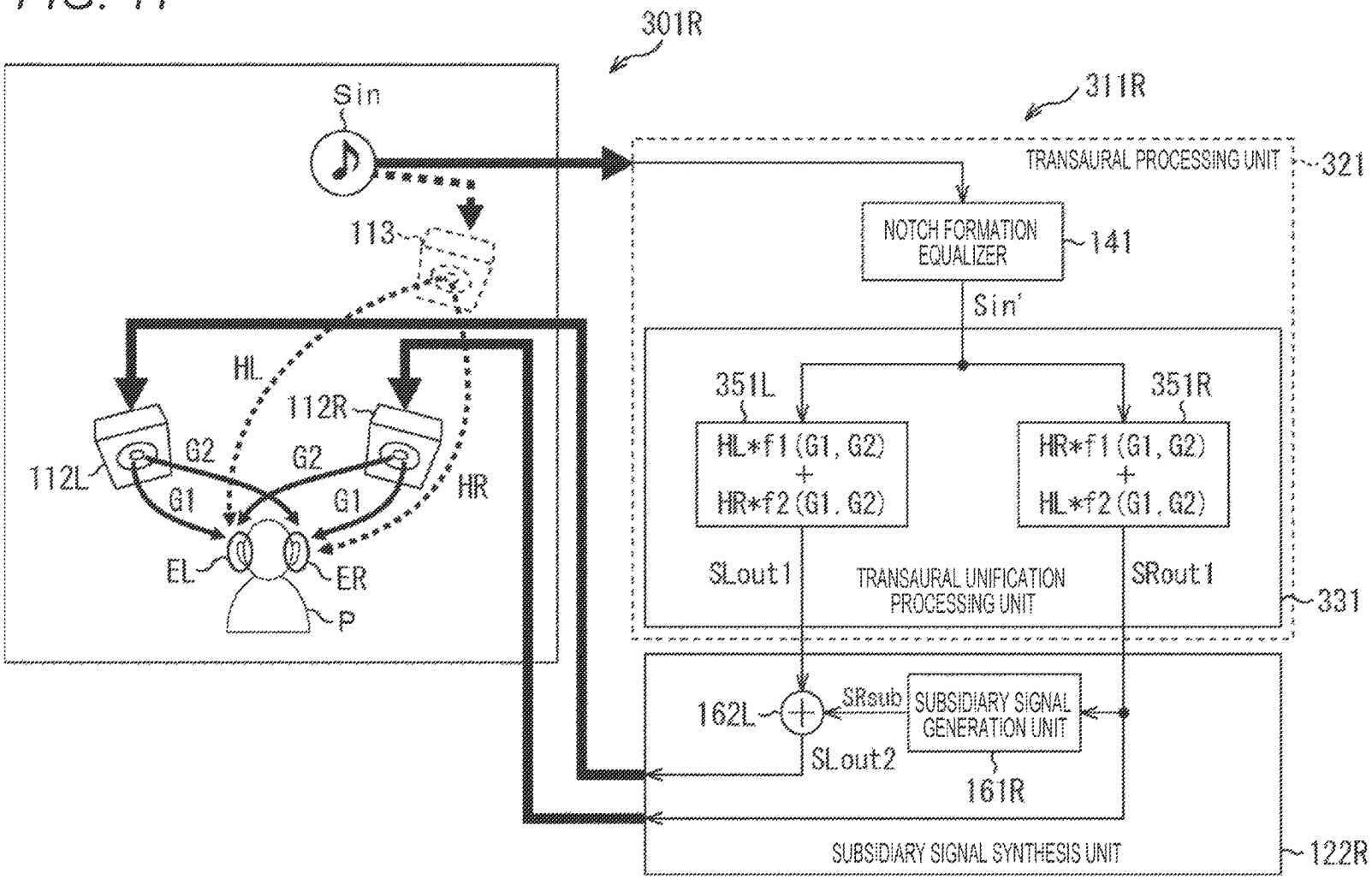
FIG. 11 is a view illustrating a modified example of the acoustic signal processing system according to the third embodiment to which the present technology has been applied.

FIG. 11 is a view illustrating a configuration example of functions of an acoustic signal processing system 201R according to a modified example of the third embodiment of the present technology. Note that parts in the figure similar to the corresponding parts in FIGS. 5 and 9 are given similar reference numbers. Repetitive description of similar processing parts is omitted where appropriate.

The acoustic signal processing system 301R is different from the acoustic signal processing system 301L illustrated in FIG. 9 in that the subsidiary signal synthesis unit 122R described above with reference to FIG. 5 is provided in place of the subsidiary signal synthesis unit 122L.

Accordingly, the acoustic signal processing system 301R is capable of localizing the virtual speaker 113 in a stable manner at a position deviated rightward from a median plane of the listener P by a method similar to the method of the acoustic signal processing system 301L.

5. Fourth Embodiment

Discussed above is an example which produces a virtual speaker (virtual sound source) only at one position. However, a virtual speaker may be produced at each of two or more positions.

For example, a virtual speaker may be produced at one position for each of left side and right side with respect to a median plane of a listener. In this case, any one of combinations of the acoustic signal processing unit 111L in FIG. 3 and the acoustic signal processing unit 111R in FIG. 5, a combination of the acoustic signal processing unit 211L in FIG. 6 and the acoustic signal processing unit 211R in FIG. 8, and a combination of the acoustic signal processing unit 311L in FIG. 9 and the acoustic signal processing unit 311R in FIG. 11 may be disposed in parallel for each virtual speaker, for example.

Note that the sound source side HRTF and the sound source opposite side HRTF associated with the corresponding virtual speaker are applied to each of the acoustic signal processing units when the plurality of acoustic signal processing units are provided in parallel. In addition, a left speaker acoustic signal included in an acoustic signal output from each of the acoustic signal processing units is added and supplied to the left speaker, while a right speaker acoustic signal included in the acoustic signal is added and supplied to the right speaker.

Figure 12:
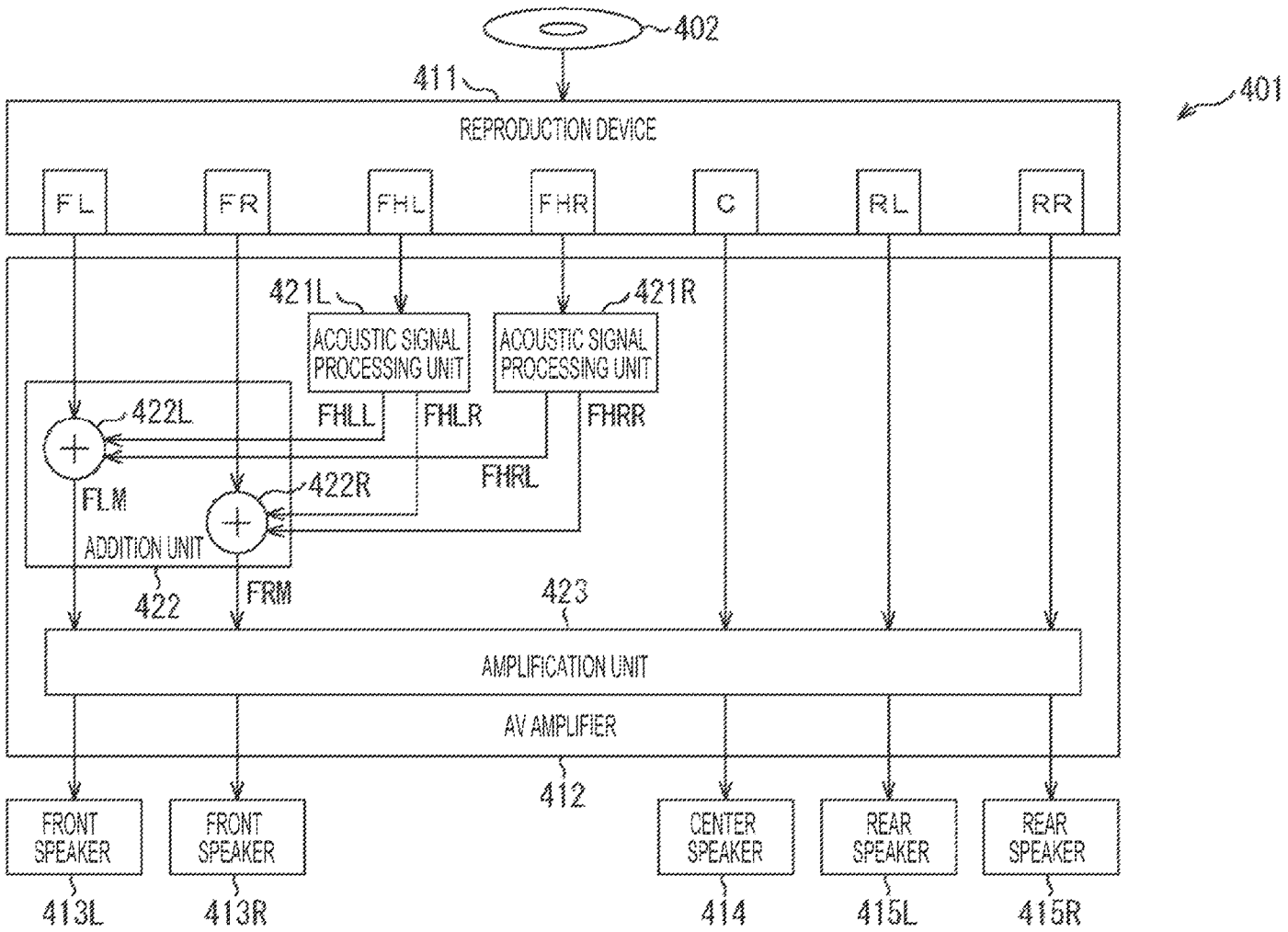
FIG. 12 is a view schematically illustrating a configuration example of functions of an audio system to which the present technology has been applied.

FIG. 12 is a block diagram schematically illustrating a configuration example of functions of an audio system 401 capable of virtually outputting sound from two virtual speakers located diagonally upper left and diagonally upper right in front of a predetermined listening position by using left and right front speakers.

The audio system 401 is configured to include a reproduction device 411, an audio/visual (AV) amplifier 412, front speakers 413L and 413R, a center speaker 414, and rear speakers 415L and 415R.

The reproduction device 411 is a reproduction device capable of reproducing at least six-channel acoustic signals for front left, front right, front center, rear left, rear right, front upper left, and front upper right positions. For example, the reproduction device 411 reproduces six-channel acoustic signals recorded in a recording medium 402 to generate and output a front left acoustic signal FL, a front right acoustic signal FR, a front center acoustic signal C, a rear left acoustic signal RL, a rear right acoustic signal RR, a front diagonally upper left signal FHL, and a front diagonally upper right signal FHR.

The AV amplifier 412 is configured to include acoustic signal processing units 421L and 421R, an addition unit 422, and an amplification unit 423. The addition unit 422 is configured to include addition units 422L and 422R.

The acoustic signal processing unit 421L is constituted by the acoustic signal processing unit 111L in FIG. 3, the acoustic signal processing unit 211L in FIG. 6, or the acoustic signal processing unit 311L in FIG. 9. The acoustic signal processing unit 421L is associated with the front diagonally upper left virtual speaker, and uses a sound source side HRTF and a sound source opposite side HRTF corresponding to this virtual speaker.

In addition, the acoustic signal processing unit 421L performs the acoustic signal process described above with reference to FIG. 4, 7, or 10 for the acoustic signal FHL to generate acoustic signals FHLL and FHLR. Note that the acoustic signal FHLL corresponds to the acoustic SLout1 in FIGS. 3, 6, and 9, while the acoustic signal FHLR corresponds to the acoustic signal SRout2 in FIGS. 3, 6, and 9. The acoustic signal processing unit 421L supplies the acoustic signal FHLL to the addition unit 422L, and supplies the acoustic signal FHLR to the addition unit 422R.

The acoustic signal processing unit 421R is constituted by the acoustic signal processing unit 111R in FIG. 5, the acoustic signal processing unit 211R in FIG. 8, or the acoustic signal processing unit 311R in FIG. 11. The acoustic signal processing unit 421R is associated with the front diagonally upper right virtual speaker, and uses a sound source side HRTF and a sound source opposite side HRTF corresponding to this virtual speaker.

In addition, the acoustic signal processing unit 421R performs the acoustic signal process described above with reference to FIG. 4, 7, or 11 for the acoustic signal FHR to generate acoustic signals FHRL and FHRR. The acoustic signal FHRL corresponds to the acoustic signal SLout2 in FIGS. 5, 8, and 11, while the acoustic signal FHRR corresponds to the acoustic signal SRout1 in FIGS. 5, 8, and 11. The acoustic signal processing unit 421L supplies the acoustic signal FHRL to the addition unit 422L, and supplies the acoustic signal FHRR to the addition unit 422R.

The addition unit 422L adds the respective acoustic signals FL, FHLL, and FHRL to generate an acoustic signal FLM, and supplies the generated acoustic signal FLM to the amplification unit 423.

The addition unit 422R adds the respective acoustic signals FR, FHLR, and FHRR to generate an acoustic signal FRM, and supplies the generated acoustic signal FRM to the amplification unit 423.

The amplification unit 423 amplifies the acoustic signals FLM through RR, and supplies the amplified signals to the front speaker 413L through 415R, respectively.

The front speaker 413L and the front speaker 413R are symmetrically disposed in the left-right direction in front of a predetermined listening position, for example. In this condition, the front speaker 413L outputs sound based on the acoustic signal FLM, while the front speaker 413R outputs sound based on the acoustic signal FRM. In this case, the listener located at the listening position feels as if sound is output not only from the front speakers 413L and 413R, but also from virtual speakers virtually disposed at two positions on the front diagonally upper left side and front diagonally upper right side.

The center speaker 414 is disposed at the center in front of the listening position, for example. In this condition, the center speaker 414 outputs sound based on the acoustic signal C.

The rear speaker 415L and the rear speaker 415R are symmetrically disposed in the left-right direction in the rear of the listening position, for example. In this condition, the rear speaker 415L outputs sound based on the acoustic signal RL, while the rear speaker 415R outputs sound based on the acoustic signal RR.

Figure 13:
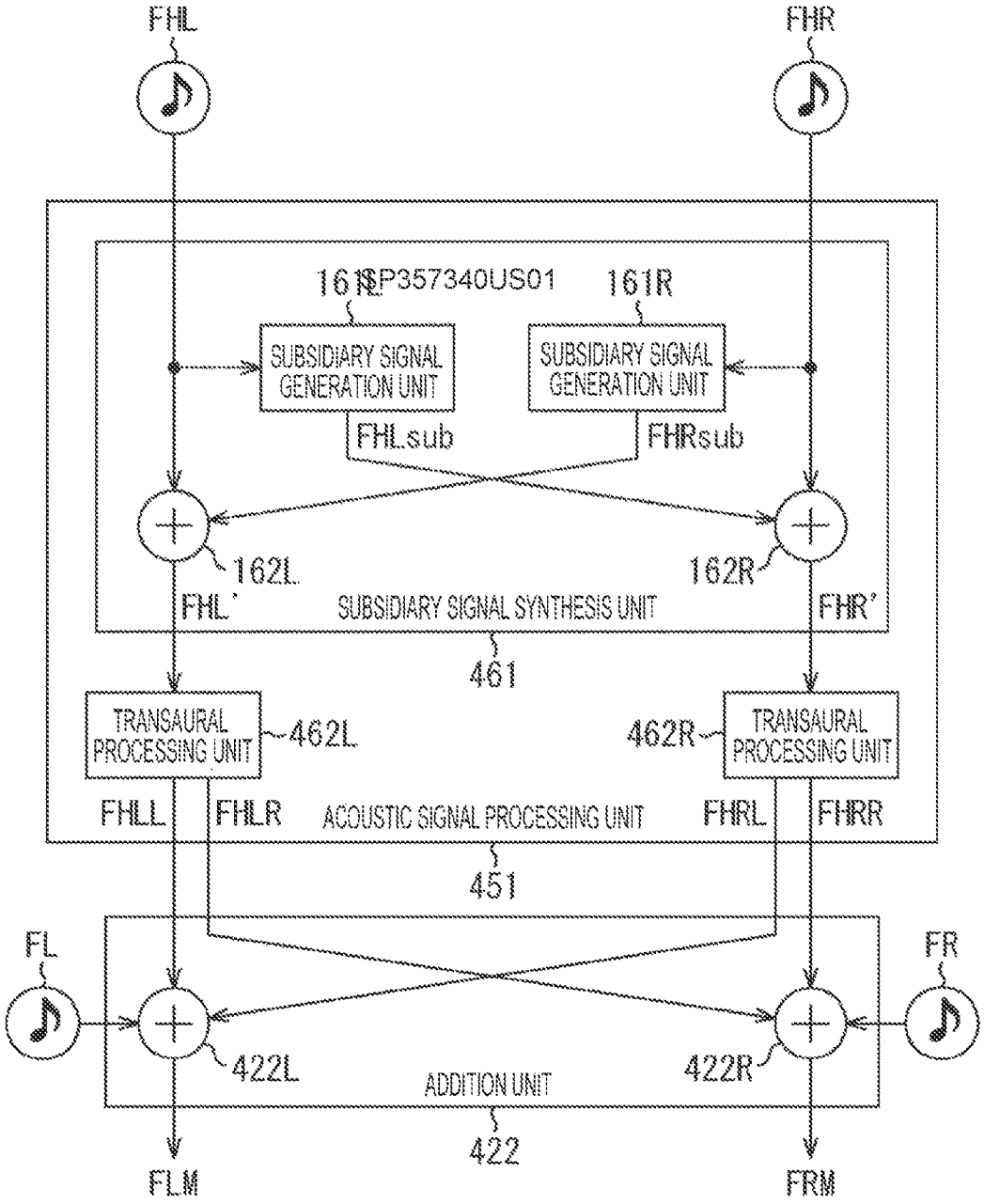
FIG. 13 is a view illustrating a modified example of an acoustic signal processing unit of the audio system to which the present technology has been applied.

Note that an acoustic signal processing unit 451 illustrated in FIG. 13 may be provided in the audio system 401 in place of the acoustic signal processing units 421L and 421R, for example. Note that parts in the figure similar to the corresponding parts in FIGS. 3 and 5 are given similar reference numbers. Repetitive description of similar processing parts is omitted where appropriate.

The acoustic signal processing unit 451 is configured to include a subsidiary signal synthesis unit 461, and transaural processing units 462L and 462R. The subsidiary signal synthesis unit 461 is configured to include the subsidiary signal generation units 161L and 161R, and the addition units 162L and 162R.

The subsidiary signal generation unit 161L extracts or attenuates a signal in a predetermined band of the acoustic signal FHL to generate a subsidiary signal FHLsub, and adjusts the signal level of the subsidiary signal FHLsub as necessary. The subsidiary signal generation unit 161L supplies the generated subsidiary signal FHLsub to the addition unit 162R.

The subsidiary signal generation unit 161R extracts or attenuates a signal in a predetermined band of the acoustic signal FHR to generate a subsidiary signal FHRsub, and adjusts the signal level of the subsidiary signal FHRsub as necessary. The subsidiary signal generation unit 161R supplies the generated subsidiary signal FHRsub to the addition unit 162R.

The addition unit 162L adds the acoustic signal FHL and the subsidiary signal FHRsub to generate an acoustic signal FHL'. The addition unit 162L supplies the acoustic signal FHL' to the transaural processing unit 462L.

The addition unit 162R adds the acoustic signal FHR and the subsidiary signal FHLsub to generate an acoustic signal FHR'. The addition unit 162R supplies the acoustic signal FHR' to the transaural processing unit 462R.

The transaural processing unit 462L is constituted by the transaural processing unit 121L in FIG. 3, the transaural processing unit 221 in FIG. 6, or the transaural processing unit 321 in FIG. 9. The transaural processing unit 462L performs a transaural process for the acoustic signal FHL' to generate an acoustic signal FHLL and an acoustic signal FHLR. The transaural processing unit 462L supplies the acoustic signal FHLL to the addition unit 422L, and supplies the acoustic signal FHLR to the addition unit 422R. Note that the acoustic signal FHLL corresponds to the acoustic signal SLout1 in FIGS. 3, 6, and 9, and that the acoustic signal FHLR corresponds to the acoustic signal SRout1 in FIGS. 3, 6, and 9.

The transaural processing unit 462R is constituted by the transaural processing unit 121R in FIG. 5, the transaural processing unit 221 in FIG. 8, or the transaural processing unit 321 in FIG. 11. The transaural processing unit 462R performs a transaural process for the acoustic signal FHR' to generate an acoustic signal FHRL and an acoustic signal FHRR. The transaural processing unit 462R supplies the acoustic signal FHRL to the addition unit 422L, and supplies the acoustic signal FHRR to the addition unit 422R. Note that the acoustic signal FHRL corresponds to the acoustic signal SLout1 in FIGS. 5, 8, and 11, and that the acoustic signal FHLR corresponds to the acoustic signal SRout1 in FIGS. 5, 8, and 11.

Accordingly, for producing two or more virtual speakers, the transaural process may be performed after addition of a subsidiary signal to an acoustic signal input from the outside, rather than before addition of the subsidiary signal.

The virtual speakers may be produced at two or more positions on the same side (left side or right side) with respect to the median plane of the listener. For example, when the virtual speakers produced at two or more positions on the left side with respect to the median plane of the listener, the acoustic signal processing unit 111L, the acoustic signal processing unit 211L, or the acoustic signal processing unit 311L may be disposed in parallel for each virtual speaker. In this case, the acoustic signals SLout1 output from the respective acoustic signal processing units are added and supplied to the left speaker, while the acoustic signals SRout2 output from the respective acoustic signal processing units are added and supplied to the right speaker. In addition, the subsidiary signal synthesis unit 122L in this structure may be commonized.

Similarly, when the virtual speakers produced at two or more positions on the right side with respect to the median plane of the listener, the acoustic signal processing unit 111R, the acoustic signal processing unit 211R, or the acoustic signal processing unit 311R may be disposed in parallel for each virtual speaker. In this case, the acoustic signals SLout2 output from the respective acoustic signal processing units are added and supplied to the left speaker, while the acoustic signals SRout1 output from the respective acoustic signal processing units are added and supplied to the right speaker. In addition, the subsidiary signal synthesis unit 122R in this structure may be commonized.

Moreover, when the acoustic signal processing unit 111L, the acoustic signal processing unit 111R, the acoustic signal processing unit 211L, or the acoustic signal processing unit 211R is provided in parallel, the crosstalk correction processing unit 132 may be commonized.

6. Modified Examples

Modified examples of the embodiments according to the present technology described above are hereinafter described.

Modified Example 1: Modified Configuration Example of Acoustic Signal Processing Unit For example, a subsidiary signal synthesis unit 501L in FIG. 14 may be employed in place of the subsidiary signal synthesis unit 122L in FIGS. 3, 6, and 9. Note that parts in the figure similar to the corresponding parts in FIG. 3 are given similar reference numbers. Repetitive description of similar processing parts is omitted where appropriate.

The subsidiary signal synthesis unit 501L is different from the subsidiary signal synthesis unit 122L in FIG. 3 in that delay units 511L and 511R are added.

When receiving the acoustic signal SLout1 from the crosstalk correction processing unit 132 in FIG. 3 or FIG. 6, or from the transaural unification processing unit 331 in FIG. 9, the delay unit 511L delays the acoustic signal SLout1 by a predetermined time after generation of the subsidiary signal SLsub, and supplies the delayed acoustic signal SLout1 to the speaker 112L.

When receiving the acoustic signal SRout1 from the crosstalk correction processing unit 132 in FIG. 3 or FIG. 6, or from the transaural unification processing unit 331 in FIG. 9, the delay unit 511R delays the acoustic signal SRout1 by the same time as the delay time of the delay unit 511L before addition of the subsidiary signal SLsub, and supplies the delayed acoustic signal SRout1 to the addition unit 162R.

When the delay units 511L and 511R are not provided, sound based on the acoustic signal SLout1 (hereinafter referred to as left main voices), sound based on the acoustic signal SRout1 (hereinafter referred to as right main voices), and sound based on subsidiary signal SLsub (hereinafter referred to as subsidiary voices) are emitted as substantially simultaneous outputs from the speakers 112L and 112R. Subsequently, the left main voices initially reach the left ear EL of the listener P, whereafter the right main voices and the subsidiary voices reach the left ear EL as substantially simultaneous voices. On the other hand, the right main voices and the subsidiary voices reach the right ear ER of the listener P as substantially simultaneous voices, whereafter the left main voices reaches the right ear ER.

However, the delay units 511L and 511R make such an adjustment that the subsidiary voices reach the left ear EL of the listener P prior to the left main voices only by a predetermined time (such as several milliseconds). This adjustment improves a feeling of localization of the virtual speaker 113, as confirmed by experiments. This improvement is considered to come from a state that forward masking included in so-called temporal masking in the left ear EL of the listener P more securely masks the first notch and the second notch of the head acoustic transmission function G1 appearing in the left main voices by using the subsidiary voices.

Figure 14:
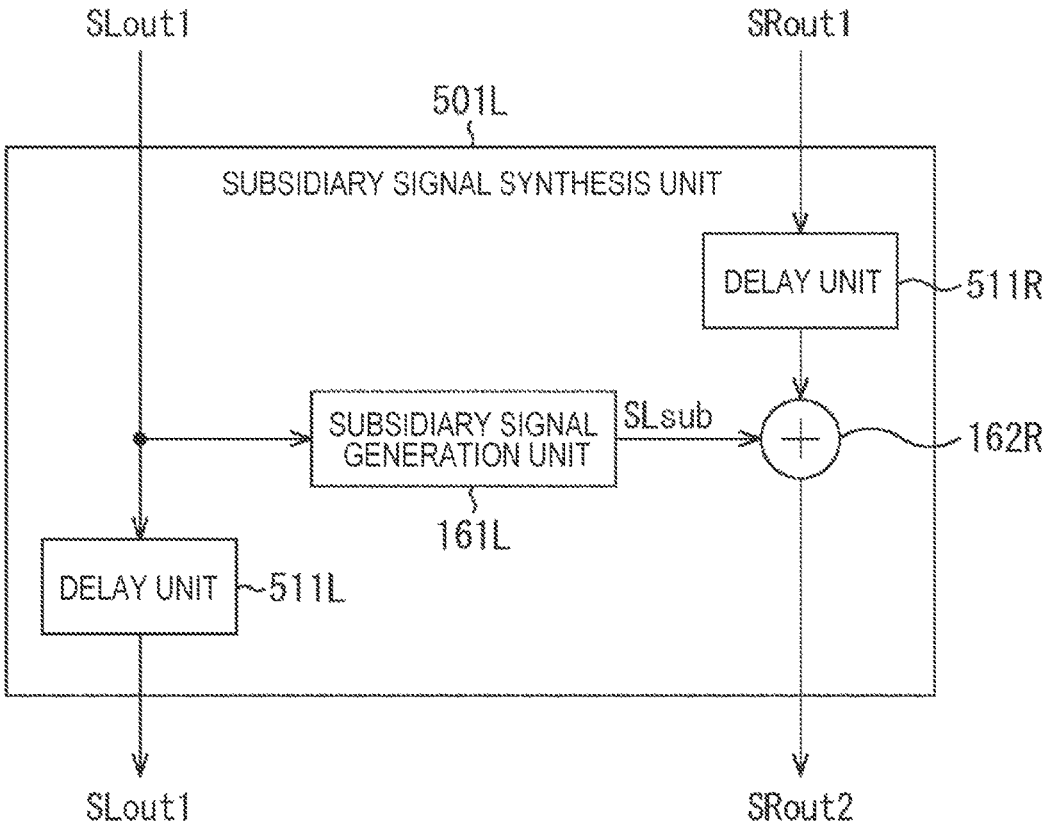
FIG. 14 is a view illustrating a modified example of a subsidiary signal synthesis unit.

Note that the subsidiary signal synthesis unit 122R in FIG. 5, 8, or 11 may include delay units similarly to the subsidiary signal synthesis unit 501L in FIG. 14, while this structure is not depicted. More specifically, a delay unit may be provided on the upstream side of the addition unit 162L, and also provided in an area between the addition unit 153R and the speaker 112R, and after a branch toward the subsidiary signal generation unit 161R.

In addition, the order of the notch formation equalizer 141 and the binaural signal generation unit 142 may be switched to one another in the binaural processing unit 131L in FIG. 3, the binaural processing unit 131R in FIG. 5, and the binaural processing unit 231 in FIGS. 6 and 8, for example.

Furthermore, the notch formation equalizer 141L and the notch formation equalizer 141R may be combined into one body in the binaural processing unit 231 in FIGS. 6 and 8, for example.

Modified Example 2: Modified Position Example of Virtual Speaker

The present technology is effective for any positions of a virtual speaker deviated leftward or rightward from a median plane of a listening position. For example, the present technology is also effective when a virtual speaker is disposed at a diagonally upper left position or diagonally upper right position in the rear of the listening position. Moreover, the present technology is also effective when a virtual speaker is disposed at a diagonally lower left position or diagonally lower right position in front of the listening position, or diagonally lower left position or diagonally lower right position in the rear of the listening position, for example. Furthermore, the present technology is also effective for a layout on the left side or the right side, for example.

Modified Example 3: Modified Position Example of Speaker for Generating Virtual Speaker Discussed above is a case when a virtual speaker is produced by using speakers symmetrically disposed in the left-right direction in front of the listening position for simplifying the description. However, according to the present technology, these speakers are not required to be symmetrically disposed in the left-right direction in front of the listening position, but may be asymmetrically disposed in the left-right direction in front of the listening position, for example. In addition, according to the present technology, the speakers are not required to be disposed in front of the listening position, but may be disposed in places other than the positions in front of the listening position (such as rear of the listening position). Note that an appropriate change of the functions used in the crosstalk correction process is needed in accordance with a change of the place of the speakers.

Note that the present technology is applicable to various types of devices and systems for realizing a virtual surround system, such as the AV amplifier described above, for example.

Configuration Example of Computer

A series of processes described above may be executed either by hardware or by software. When the series of processes is executed by software, programs constituting the software are installed into a computer. Examples of the computer used herein include a computer incorporated in dedicated hardware, and a general-purpose personal computer capable of executing various types of functions under various types of installed programs.

Figure 15:
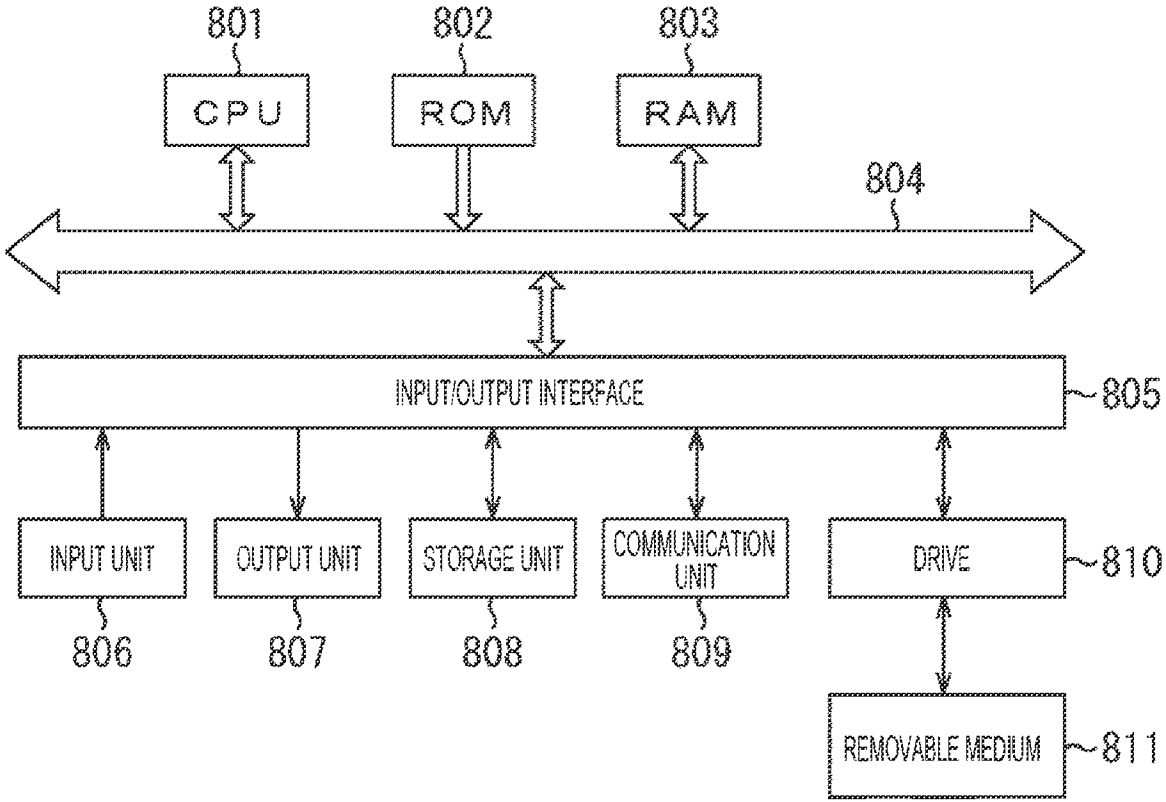
FIG. 15 is a block diagram illustrating a configuration example of a computer.

FIG. 15 is a block diagram illustrating a configuration example of hardware of a computer which executes the series of processes described above under the programs.

A central processing unit (CPU) 801, a read only memory (ROM) 802, and a random access memory (RAM) (803) of the computer are connected to each other via a bus 804.

An input/output interface 805 is further connected to the bus 804. An input unit 806, an output unit 807, a storage unit 808, a communication unit 809, and a drive 810 are connected to the input/output interface 805.

The input unit 806 is constituted by a keyboard, a mouse, a microphone or the like. The output unit 807 is constituted by a display, a speaker or the like. The storage unit 808 is constituted by a hard disk, a non-volatile memory or the like. The communication unit 809 is constituted by a network interface or the like. The drive 810 drives a removable medium 811 such as a magnetic disk, an optical disk, a magneto-optical disk, and a semiconductor memory.

According to the computer having this structure, the CPU 801 loads programs from the storage unit 808 storing these programs into the RAM 803 via the input/output interface 805 and the bus 804, and executes the loaded programs to perform the series of processes described above, for example.

The programs executed by the computer (CPU 801) may be recorded in the removable medium 811 such as a package medium, and provided in the form of the removable medium 811, for example. Alternatively, the programs may be provided via a wired or wireless transmission medium, such as a local area network, the Internet, and digital satellite broadcasting.

The programs of the computer may be supplied from the removable medium 811 attached to the drive 810, and installed into the storage unit 808 via the input/output interface 805. Alternatively, the programs may be received by the communication unit 809 via a wired or wireless transmission medium, and installed into the storage unit 808. Instead, the programs may be pre-installed in the ROM 802 or the storage unit 808.

Note that the programs executed by the computer may be programs under which processes are executed in time series in the order described in the present specification, or executed in parallel or at necessary timing such as on occasions of calls.

Moreover, according to the present specification, a system refers to a collection of a plurality of constituent elements (devices, modules (parts) and the like). All the constituent elements may be provided within an identical housing, or may be provided otherwise. Accordingly, multiple devices accommodated in separate housings and connected via a network, and one device including multiple modules accommodated within one housing are both regarded as systems.

Furthermore, embodiments according to the present technology are not limited to the embodiments described herein. Various modifications may be made without departing from the scope of the present technology.

For example, the present technology may adopt a cloud computing structure where a plurality of devices share one function and perform the function in cooperation with each other via a network.

In addition, the respective steps discussed with reference to the foregoing flowcharts may be shared and executed by multiple devices rather than executed by one device.

Furthermore, when multiple processes are contained in one step, the multiple processes contained in the one step may be shared and executed by multiple devices rather than executed by one device.

Besides, advantageous effects described in the present specification are presented only by way of example. Other advantageous effects may be offered. The present technology may further have following configurations, for example.

(1)

An acoustic signal processing device including:

a first transaural processing unit that performs a predetermined transaural process for a first input signal corresponding to an acoustic signal for a first virtual sound source deviated leftward or rightward from a median plane of a predetermined listening position, by using a first head acoustic transmission function between the first virtual sound source and one of both ears of a listener located at the listening position, which ear is located on a side away from the first virtual sound source, and by using a second head acoustic transmission function between the first virtual sound source and the other of the both ears of the listener, which ear is located on a side close to the first virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function; and a first subsidiary signal synthesis unit that adds a first subsidiary signal constituted by a component in a predetermined band of the second acoustic signal to the first acoustic signal to generate a third acoustic signal.

(2)

The acoustic signal processing device according to (1) described above, wherein the band of the first subsidiary signal at least includes the lowest band and the second lowest band in a range of a predetermined second frequency or higher frequencies in bands of appearance of the notches in a third head acoustic transmission function between one of the both ears of the listener and one of two speakers disposed on left and right sides with respect to the listening position, the lowest band and the second lowest band in a range of a predetermined third frequency or higher frequencies in bands of appearance of the notches in a fourth head acoustic transmission function between the other ear of the listener and the other of the two speakers, the lowest band and the second lowest band in a range of a predetermined fourth frequency or higher frequencies in bands of appearance of the notches in a fifth head acoustic transmission function between the other ear and the one speaker, and the lowest band and the second lowest band at a predetermined fifth frequency or higher frequencies in the bands of appearance of notches in a sixth head acoustic transmission function between the one ear and the other speaker.

(3)

The acoustic signal processing device according to (1) or (2) described above, further including:

a first delay unit that delays the first acoustic signal by a predetermined time before addition of the first subsidiary signal; and a second delay unit that delays the second acoustic signal by a predetermined time after generation of the first subsidiary signal.

(4)

The acoustic signal processing device according to any one of (1) through (3) described above, wherein the first subsidiary signal synthesis unit adjusts a level of the first subsidiary signal before addition of the first subsidiary signal to the first acoustic signal.

(5)

The acoustic signal processing device according to any one of (1) through (4) described above, further including:

a second transaural processing unit that performs a predetermined transaural process for a second input signal corresponding to an acoustic signal for a second virtual sound source deviated leftward or rightward from the median plane, by using a seventh head acoustic transmission function between the second virtual sound source and one of the both ears of the listener, which ear is located away from the second virtual sound source, and by using an eighth head acoustic transmission function between the second virtual sound source and the other ear of the both ears of the listener, which ear is located close to the second virtual sound source, to generate a fourth acoustic signal, and a fifth acoustic signal containing attenuated components in a third band which is the lowest band, and a fourth band which is the second lowest band in a range of a predetermined sixth frequency or higher frequencies, in bands of appearance of the notches in the seventh head acoustic transmission function;

a second subsidiary signal synthesis unit that adds a second subsidiary signal constituted by a component in the fifth acoustic signal in the same band as the band of the first subsidiary signal to the fourth acoustic signal to generate a sixth acoustic signal; and an addition unit that adds the third acoustic signal and the fifth acoustic signal and adds the second acoustic signal and the sixth acoustic signal when positions of the first virtual sound source and the second virtual sound source are separated into a left side and a right side with respect to the median plane, and adds the third acoustic signal and the sixth acoustic signal and adds the second acoustic signal and the fifth acoustic signal when the first virtual sound source and the second virtual sound source are disposed on the same side with respect to the median plane.

(6)

The acoustic signal processing device according to any one of (1) through (5) described above, wherein the first frequency is a frequency at which a positive peak appears around 4 kHz in the first head acoustic transmission function.

(7)

The acoustic signal processing device according to any one of (1) through (6) described above, wherein the first transaural processing unit includes a first binaural processing unit that generates a first binaural signal containing the first input signal and the first head acoustic transmission function superimposed on the first input signal, a second binaural processing unit that generates a second binaural signal which is a signal including the first input signal and the second head acoustic transmission function superimposed on the first input signal, and containing attenuated components in the first band and the second band of the signal, and a crosstalk correction processing unit that performs a crosstalk correction process for the first binaural signal and the second binaural signal for canceling an acoustic transmission characteristic between the ear away from the first virtual sound source and one of two speakers disposed on left and right sides with respect to the listening position, which speaker is located on the side opposite to the first virtual sound source with respect to the median plane, an acoustic transmission characteristic between the ear close to the first virtual sound source and the other speaker of the two speakers, which speaker is located on the virtual sound source side with respect to the median plane, a crosstalk from the speaker on the side opposite to the first virtual sound source to the ear close to the first virtual sound source, and a crosstalk from the virtual sound source side speaker to the ear away from the first virtual sound source.

(8)

The acoustic signal processing device according to (7) described above, wherein the first binaural processing unit generates a third binaural signal that contains attenuated components in the first band and the second band of the first binaural signal, and the crosstalk correction processing unit performs the crosstalk correction process for the second binaural signal and the third binaural signal.

(9)

The acoustic signal processing device according to any one of (1) through (6) described above, wherein the first transaural processing unit includes an attenuation unit that generates an attenuation signal containing attenuated components in the first band and the second band of the first input signal, and a signal processing unit that performs, as a unified process, a process for generating a first binaural signal containing the attenuation signal and the first head acoustic transmission function superimposed on the attenuation signal, and a second binaural signal containing the attenuation signal and the second head acoustic transmission function superimposed on the attenuation signal, and a process for the first binaural signal and the second binaural signal for canceling an acoustic transmission characteristic between the ear away from the first virtual sound source and one of two speakers disposed on left and right sides with respect to the listening position, which speaker is located on the side opposite to the first virtual sound source with respect to the median plane, an acoustic transmission characteristic between the ear close to the first virtual sound source and the other speaker of the two speakers, which speaker is located on the virtual sound source side with respect to the median plane, a crosstalk from the speaker on the side opposite to the first virtual sound source to the ear close to the first virtual sound source, and a crosstalk from the virtual sound source side speaker to the ear away from the first virtual sound source.

(10)

An acoustic signal processing method including:

a transaural processing step that performs a predetermined transaural process for an input signal corresponding to an acoustic signal for a virtual sound source deviated leftward or rightward from a median plane of a predetermined listening position, by using a first head acoustic transmission function between the virtual sound source and one of both ears of a listener located at the listening position, which ear is located on a side away from the virtual sound source, and by using a second head acoustic transmission function between the virtual sound source and the other of the both ears of the listener located at the listening position, which ear is located on a side close to the virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function; and a subsidiary signal synthesis step that adds a subsidiary signal constituted by a component in a predetermined band of the second acoustic signal to the first acoustic signal to generate a third acoustic signal.

(11)

A program causing a computer to execute a process including:

a transaural processing step that performs a predetermined transaural process for an input signal corresponding to an acoustic signal for a virtual sound source deviated leftward or rightward from a median plane of a predetermined listening position, by using a first head acoustic transmission function between the virtual sound source and one of both ears of a listener located at the listening position, which ear is located on a side away from the virtual sound source, and by using a second head acoustic transmission function between the virtual sound source and the other of the both ears of the listener located at the listening position, which ear is located on a side close to the virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function; and a subsidiary signal synthesis step that adds a subsidiary signal constituted by a component in a predetermined band of the second acoustic signal to the first acoustic signal to generate a third acoustic signal.

(12)

An acoustic signal processing device including:

a subsidiary signal synthesis unit that adds a first subsidiary signal to a first input signal to generate a first synthesis signal, and adds a second subsidiary signal to a second input signal to generate a second synthesis signal, the first input signal corresponding to an acoustic signal for a first virtual sound source deviated leftward or rightward from a median plane of a predetermined listening position, the second input signal corresponding to an acoustic signal for a second virtual sound source deviated leftward or rightward from the median plane, the first subsidiary signal constituted by a component in a predetermined band of the second input signal, and the second subsidiary signal constituted by a component in the first input signal in the same band as the band of the first subsidiary signal;

a first transaural processing unit that performs a predetermined transaural process for the first synthesis signal by using a first head acoustic transmission function between the first virtual sound source and one of both ears of a listener located at the listening position, which ear is located on a side away from the first virtual sound source, and by using a second head acoustic transmission function between the first virtual sound source and the other of the both ears of the listener, which ear is located on a side close to the first virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function; and a second transaural processing unit that performs a predetermined transaural process for the second synthesis signal by using a third head acoustic transmission function between the second virtual sound source and one of the both ears of the listener, which ear is located away from the second virtual sound source, and by using a fourth head acoustic transmission function between the second virtual sound source and the other ear of the both ears of the listener, which ear is located close to the second virtual sound source, to generate a third acoustic signal, and a fourth acoustic signal containing attenuated components in a third band which is the lowest band, and a fourth band which is the second lowest band in a range of a predetermined second frequency or higher frequencies, in bands of appearance of the notches in the third head acoustic transmission function.

(13)

The acoustic signal processing device according to (12) described above, further including: an addition unit that adds the first acoustic signal and the fourth acoustic signal and adds the second acoustic signal and the third acoustic signal when positions of the first virtual sound source and the second virtual sound source are separated into a left side and a right side with respect to the median plane, and adds the first acoustic signal and the third acoustic signal and adds the second acoustic signal and the fourth acoustic signal when the first virtual sound source and the second virtual sound source are disposed on the same side with respect to the median plane.

(14)

The acoustic signal processing device according to (12) or (13) described above, wherein the bands of the first subsidiary signal and the second subsidiary signal at least include the lowest band and the second lowest band in a range of a predetermined third frequency or higher frequencies in bands of appearance of the notches in a fifth head acoustic transmission function between one of the both ears of the listener and one of two speakers disposed on left and right sides with respect to the listening position, the lowest band and the second lowest band in a range of a predetermined fourth frequency or higher frequencies in bands of appearance of the notches in a sixth head acoustic transmission function between the other ear of the listener and the other of the two speakers, the lowest band and the second lowest band in a range of a predetermined fifth frequency or higher frequencies in bands of appearance of the notches in a seventh head acoustic transmission function between the other ear and the one speaker, and the lowest band and the second lowest band at a predetermined sixth frequency or higher frequencies in the bands of appearance of notches in an eighth head acoustic transmission function between the one ear and the other speaker.

(15)

The acoustic signal processing device according to any one of (12) through (14) described above, wherein the first frequency is a frequency at which a positive peak appears around 4 kHz in the first head acoustic transmission function, and the second frequency is a frequency at which a positive peak appears around 4 kHz in the third head acoustic transmission function.

(16)

The acoustic signal processing device according to any one of (12) through (15) described above, wherein the first transaural processing unit includes a first binaural processing unit that generates a first binaural signal containing the first head acoustic transmission function superimposed on the first synthesis signal, a second binaural processing unit that generates a second binaural signal which contains attenuated components in the first band and the second band in a signal containing the second head acoustic transmission function superimposed on the first synthesis signal, and a first crosstalk correction processing unit that performs a crosstalk correction process for the first binaural signal and the second binaural signal for canceling an acoustic transmission characteristic between the ear away from the first virtual sound source and one of two speakers disposed on left and right sides with respect to the listening position, which speaker is located on the side opposite to the first virtual sound source with respect to the median plane, an acoustic transmission characteristic between the ear close to the first virtual sound source and the other speaker of the two speakers, which speaker is located on the first virtual sound source side with respect to the median plane, a crosstalk from the speaker on the side opposite to the first virtual sound source to the ear close to the first virtual sound source, and a crosstalk from the first virtual sound source side speaker to the ear away from the first virtual sound source, and the second transaural processing unit includes a third binaural processing unit that generates a third binaural signal containing the second synthesis signal and the third head acoustic transmission function superimposed on the second synthesis signal, a fourth binaural processing unit that generates a fourth binaural signal which is a signal including the second synthesis signal and the fourth head acoustic transmission function superimposed on the second synthesis signal, and containing attenuated components in the third band and the fourth band of the signal, and a second crosstalk correction processing unit that performs a crosstalk correction process for the third binaural signal and the fourth binaural signal for canceling an acoustic transmission characteristic between the ear away from the second virtual sound source and one of two speakers, which speaker is located on the side opposite to the second virtual sound source with respect to the median plane, an acoustic transmission characteristic between the ear close to the second virtual sound source and the other speaker of the two speakers, which speaker is located on the second virtual sound source side with respect to the median plane, a crosstalk from the speaker on the side opposite to the second virtual sound source to the ear close to the second virtual sound source, and a crosstalk from the second virtual sound source side speaker to the ear away from the second virtual sound source.

(17)

The acoustic signal processing device according to (16) described above, wherein the first binaural processing unit generates a fifth binaural signal that contains attenuated components in the first band and the second band of the first binaural signal, the first crosstalk correction processing unit performs the crosstalk correction process for the second binaural signal and the fifth binaural signal, the third binaural processing unit generates a sixth binaural signal that contains attenuated components in the third band and the fourth band of the third binaural signal, and the second crosstalk correction processing unit performs the crosstalk correction process for the fourth binaural signal and the sixth binaural signal.

(18)

The acoustic signal processing device according to any one of (12) through (15) described above, wherein the first transaural processing unit includes a first attenuation unit that generates a first attenuation signal containing attenuated components in the first band and the second band of the first synthesis signal, and a first signal processing unit that performs, as a unified process, a process for generating a first binaural signal containing the first attenuation signal and the first head acoustic transmission function superimposed on the first attenuation signal, and a second binaural signal containing the first attenuation signal and the second head acoustic transmission function superimposed on the first attenuation signal, and a process for the first binaural signal and the second binaural signal for canceling an acoustic transmission characteristic between the ear away from the first virtual sound source and one of two speakers disposed on left and right sides with respect to the listening position, which speaker is located on the side opposite to the first virtual sound source with respect to the median plane, an acoustic transmission characteristic between the ear close to the first virtual sound source and the other speaker of the two speakers, which speaker is located on the first virtual sound source side with respect to the median plane, a crosstalk from the speaker on the side opposite to the first virtual sound source to the ear close to the first virtual sound source, and a crosstalk from the first virtual sound source side speaker to the ear away from the first virtual sound source, and the second transaural processing unit includes a second attenuation unit that generates a second attenuation signal containing attenuated components in the third band and the fourth band of the second synthesis signal, and a signal processing unit that performs, as a unified process, a process for generating a third binaural signal containing the second attenuation signal and the third head acoustic transmission function superimposed on the second attenuation signal, and a fourth binaural signal containing the second attenuation signal and the fourth head acoustic transmission function superimposed on the second attenuation signal, and a process for the third binaural signal and the fourth binaural signal for canceling an acoustic transmission characteristic between the ear away from the second virtual sound source and one of two speakers, which speaker is located on the side opposite to the second virtual sound source with respect to the median plane, an acoustic transmission characteristic between the ear close to the second virtual sound source and the other speaker of the two speakers, which speaker is located on the second virtual sound source side with respect to the median plane, a crosstalk from the speaker on the side opposite to the second virtual sound source to the ear close to the second virtual sound source, and a crosstalk from the second virtual sound source side speaker to the ear away from the second virtual sound source.

(19)

An acoustic signal processing method including:

a subsidiary signal synthesis step that adds a first subsidiary signal to a first input signal to generate a first synthesis signal, and adds a second subsidiary signal to a second input signal to generate a second synthesis signal, the first input signal corresponding to an acoustic signal for a first virtual sound source deviated leftward or rightward from a median plane of a predetermined listening position, the second input signal corresponding to an acoustic signal for a second virtual sound source deviated leftward or rightward from the median plane, the first subsidiary signal constituted by a component in a predetermined band of the second input signal, and the second subsidiary signal constituted by a component in the first input signal in the same band as the band of the first subsidiary signal;

a first transaural processing step that performs a predetermined transaural process for the first synthesis signal by using a first head acoustic transmission function between the first virtual sound source and one of both ears of a listener located at the listening position, which ear is located on a side away from the first virtual sound source, and by using a second head acoustic transmission function between the first virtual sound source and the other of the both ears of the listener, which ear is located on a side close to the first virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function; and a second transaural processing step that performs a predetermined transaural process for the second synthesis signal by using a third head acoustic transmission function between the second virtual sound source and one of the both ears of the listener, which ear is located away from the second virtual sound source, and by using a fourth head acoustic transmission function between the second virtual sound source and the other ear of the both ears of the listener, which ear is located close to the second virtual sound source, to generate a third acoustic signal, and a fourth acoustic signal containing attenuated components in a third band which is the lowest band, and a fourth band which is the second lowest band in a range of a predetermined second frequency or higher frequencies, in bands of appearance of the notches in the third head acoustic transmission function.

(20)

A program causing a computer to execute a process including:

a subsidiary signal synthesis step that adds a first subsidiary signal to a first input signal to generate a first synthesis signal, and adds a second subsidiary signal to a second input signal to generate a second synthesis signal, the first input signal corresponding to an acoustic signal for a first virtual sound source deviated leftward or rightward from a median plane of a predetermined listening position, the second input signal corresponding to an acoustic signal for a second virtual sound source deviated leftward or rightward from the median plane, the first subsidiary signal constituted by a component in a predetermined band of the second input signal, and the second subsidiary signal constituted by a component in the first input signal in the same band as the band of the first subsidiary signal;

a first transaural processing step that performs a predetermined transaural process for the first synthesis signal by using a first head acoustic transmission function between the first virtual sound source and one of both ears of a listener located at the listening position, which ear is located on a side away from the first virtual sound source, and by using a second head acoustic transmission function between the first virtual sound source and the other of the both ears of the listener, which ear is located on a side close to the first virtual sound source, to generate a first acoustic signal, and a second acoustic signal containing attenuated components in a first band which is the lowest band, and a second band which is the second lowest band in a range of a predetermined first frequency or higher frequencies, in bands of appearance of notches each of which corresponds to a negative peak of an amplitude having a predetermined depth or larger in the first head acoustic transmission function; and a second transaural processing step that performs a predetermined transaural process for the second synthesis signal by using a third head acoustic transmission function between the second virtual sound source and one of the both ears of the listener, which ear is located away from the second virtual sound source, and by using a fourth head acoustic transmission function between the second virtual sound source and the other ear of the both ears of the listener, which ear is located close to the second virtual sound source, to generate a third acoustic signal, and a fourth acoustic signal containing attenuated components in a third band which is the lowest band, and a fourth band which is the second lowest band in a range of a predetermined second frequency or higher frequencies, in bands of appearance of the notches in the third head acoustic transmission function.

REFERENCE SIGNS LIST

101L, 101R Acoustic signal processing system
111L, 111R Acoustic signal processing unit
112L, 112R Speaker
113 Virtual speaker
121L, 121R Transaural processing unit
122L, 122R Subsidiary signal synthesis unit
131L, 131R Binaural processing unit
132 Crosstalk correction processing unit
141, 141L, 141R Notch formation equalizer
142L, 142R Binaural signal generation unit
151L through 152R Signal processing unit
153L, 153R Addition unit
161L, 161R Subsidiary signal generation unit
162L, 162R Addition unit
201L, 201R Acoustic signal processing system
211L, 211R Acoustic signal processing unit
221 Transaural processing unit
231 Binaural processing unit
301L, 301R Acoustic signal processing system
311L, 311R Acoustic signal processing unit
321 Transaural processing unit
331 Transaural unification processing unit
351L, 351R Signal processing unit
401 Audio system
412 AV amplifier
421L, 421R Acoustic signal processing unit
422L, 422R Addition unit
451 Acoustic signal processing unit
461 Subsidiary signal synthesis unit
462L, 462R Transaural processing unit
501L Subsidiary signal synthesis unit
511L, 511R Delay unit
EL Left ear
ER Right ear
G1, G2, HL, HR Head acoustic transmission function
P Listener

The invention claimed is:

1. An acoustic signal processing device, comprising:

a first transaural processing unit configured to:

control a first transaural process for a first input signal, wherein the first input signal corresponds to an acoustic signal for a first virtual sound source deviated one of leftward or rightward from a median plane of a listener's position;

generate a first acoustic signal and a second acoustic signal based on:

a first head acoustic transmission function between the first virtual sound source and a listener's first ear, wherein the listener's first ear is located on a first side away from the first virtual sound source, and a second head acoustic transmission function between the first virtual sound source and a listener's second ear, wherein the listener's second ear is located on a second side close to the first virtual sound source, wherein the second acoustic signal comprises first attenuated components in a first band and a second band, the first band is a lowest band and the second band is a second lowest band in a first range of one of a first frequency or frequencies higher than the first frequency, the first frequency and the frequencies higher than the first frequency are in bands of appearance of notches, each notch of the notches corresponds to a negative peak of an amplitude having a first depth and a second depth, and a first frequency band where the first depth exists is lower than a second frequency band where the second depth exists in the first head acoustic transmission function; and a first subsidiary signal synthesis unit configured to add a first subsidiary signal to the first acoustic signal for generation of a third acoustic signal, wherein the first subsidiary signal is constituted by a first component in a band of the second acoustic signal, a band of the first subsidiary signal comprises:

a lowest band and a second lowest band in a second range of one of a second frequency or frequencies higher than the second frequency in first bands of appearance of the notches in a third head acoustic transmission function, wherein the third head acoustic transmission function is between the listener's first ear and a first speaker on a left side with respect to the listener's position, a lowest band and a second lowest band in a third range of one of a third frequency or frequencies higher than the third frequency in second bands of appearance of the notches in a fourth head acoustic transmission function, wherein the fourth head acoustic transmission function is between the listener's second ear and a second speaker on a right side with respect to the listener's position, a lowest band and a second lowest band in one of a fourth range of a fourth frequency or frequencies higher than the fourth frequency in third bands of appearance of the notches in a fifth head acoustic transmission function, wherein the fifth head acoustic transmission function is between the listener's second ear and the first speaker, and a lowest band and a second lowest band in one of a fifth frequency or frequencies higher than the fifth frequency in fourth bands of appearance of the notches in a sixth head acoustic transmission function, wherein the sixth head acoustic transmission function is between the listener's first ear and the second speaker.

2. The acoustic signal processing device according to claim 1, further comprising:

a first delay unit configured to delay the first acoustic signal by a first time before the addition of the first subsidiary signal; and a second delay unit configured to delay the second acoustic signal by a second time after generation of the first subsidiary signal.

3. The acoustic signal processing device according to claim 1, wherein the first subsidiary signal synthesis unit is further configured to adjust a level of the first subsidiary signal before the addition of the first subsidiary signal to the first acoustic signal.

4. The acoustic signal processing device according to claim 1, wherein the first frequency is a frequency at which a positive peak is around 4 kHz in the first head acoustic transmission function.

5. The acoustic signal processing device according to claim 1, wherein the first transaural processing unit includes:

a first binaural processing unit configured to generate a first binaural signal including the first input signal and the first head acoustic transmission function superimposed on the first input signal; and a second binaural processing unit configured to generate a second binaural signal including the first input signal and the second head acoustic transmission function superimposed on the first input signal, and the second head acoustic transmission function comprises third attenuated components in the first band and the second band of the second binaural signal.

6. The acoustic signal processing device according to claim 5, wherein the first transaural processing unit includes:

a crosstalk correction processing unit configured to:

control a first crosstalk correction process for the first binaural signal and the second binaural signal; and control cancellation of:

a first acoustic transmission characteristic between the listener's first ear away from the first virtual sound source and the first speaker on the left side with respect to the listener's position, wherein the first speaker is located on a third side opposite to the first virtual sound source with respect to the median plane, a second acoustic transmission characteristic between the listener's second ear close to the first virtual sound source and the second speaker, wherein the second speaker is located on a virtual sound source side with respect to the median plane and the second speaker is on the right side with respect to the listener's position, a first crosstalk from the first speaker on the third side opposite to the first virtual sound source to the listener's second ear close to the first virtual sound source, and a second crosstalk from a virtual sound source side speaker to the listener's first ear away from the first virtual sound source.

7. The acoustic signal processing device according to claim 6, wherein the first binaural processing unit is further configured to generate a third binaural signal that contains fourth attenuated components in the first band and the second band of the first binaural signal, and the crosstalk correction processing unit is further configured to control a second crosstalk correction process for the second binaural signal and the third binaural signal.

8. The acoustic signal processing device according to claim 1, further comprising:

a second transaural processing unit configured to:

control a second transaural process for a second input signal, wherein the second input signal corresponds to an acoustic signal for a second virtual sound source deviated one of leftward or rightward from the median plane; and generate a fourth acoustic signal and a fifth acoustic signal based on:

a seventh head acoustic transmission function between the second virtual sound source and the listener's first ear, wherein the listener's first ear is located away from the second virtual sound source, and an eighth head acoustic transmission function between the second virtual sound source and the listener's second ear, wherein the listener's second ear is located close to the second virtual sound source, wherein the fifth acoustic signal comprises second attenuated components in a third band and a fourth band, and the third band is a lowest band and the fourth band is a second lowest band in a fifth range of a sixth frequency or frequencies higher than the sixth frequency in fifth bands of appearance of the notches in the seventh head acoustic transmission function.

9. The acoustic signal processing device according to claim 8, further comprising:

a second subsidiary signal synthesis unit configured to add a second subsidiary signal to the fourth acoustic signal to generate a sixth acoustic signal, wherein the second subsidiary signal is constituted by a second component in the fifth acoustic signal in a same band as the band of the first subsidiary signal; and an addition unit configured to:

add the third acoustic signal and the fifth acoustic signal, add the second acoustic signal and the sixth acoustic signal based on positions of the first virtual sound source and the second virtual sound source separated into a left side and a right side with respect to the median plane, add the third acoustic signal and the sixth acoustic signal, and add the second acoustic signal and the fifth acoustic signal based on the first virtual sound source and the second virtual sound source that are on a same side with respect to the median plane.

10. An acoustic signal processing method, comprising:

controlling a transaural process for an input signal, wherein the input signal corresponds to an acoustic signal for a virtual sound source deviated one of leftward or rightward from a median plane of a listener's position;

generating a first acoustic signal and a second acoustic signal based on:

a first head acoustic transmission function between the virtual sound source and a listener's first ear, wherein the listener's first ear is located on a first side away from the virtual sound source, and a second head acoustic transmission function between the virtual sound source and a listener's second ear, wherein the listener's second ear is located on a second side close to the virtual sound source, wherein the second acoustic signal comprises attenuated components in a first band and a second band, the first band is a lowest band and the second band is a second lowest band in a range of one of a first frequency or frequencies higher than the first frequency, the first frequency and the frequencies higher than the first frequency are in bands of appearance of notches, each notch of the notches corresponds to a negative peak of an amplitude having a first depth and a second depth, a first frequency band where the first depth exists is lower than a second frequency band where the second depth exists in the first head acoustic transmission function; and adding a subsidiary signal to the first acoustic signal for generating for generation of a third acoustic signal, wherein the subsidiary signal is constituted by a component in a band of the second acoustic signal, a band of the subsidiary signal comprises:

a lowest band and a second lowest band in a second range of one of a second frequency or frequencies higher than the second frequency in first bands of appearance of the notches in a third head acoustic transmission function, wherein the third head acoustic transmission function is between the listener's first ear and a first speaker on a left side with respect to the listener's position, a lowest band and a second lowest band in one of a third range of a third frequency or frequencies higher than the third frequency in second bands of appearance of the notches in a fourth head acoustic transmission function, wherein the fourth head acoustic transmission function is between the listener's second ear and a second speaker on a right side with respect to the listener's position, a lowest band and a second lowest band in one of a fourth range of a fourth frequency or frequencies higher than the fourth frequency in third bands of appearance of the notches in a fifth head acoustic transmission function, wherein the fifth head acoustic transmission function is between the listener's second ear and the first speaker, and a lowest band and a second lowest band in one of a fifth frequency or frequencies higher than the fifth frequency in fourth bands of appearance of the notches in a sixth head acoustic transmission function, wherein the sixth head acoustic transmission function is between the listener's first ear and the second speaker.

11. A non-transitory computer-readable medium having stored thereon computer-executable instructions, which when executed by a computer, cause the computer to execute operations, the operations comprising:

controlling a transaural process for an input signal, wherein the input signal corresponds to an acoustic signal for a virtual sound source deviated one of leftward or rightward from a median plane of a listener's position;

generating a first acoustic signal and a second acoustic signal based on:

a first head acoustic transmission function between the virtual sound source and a listener's first ear, wherein the listener's first ear is located on a first side away from the virtual sound source, and a second head acoustic transmission function between the virtual sound source and a listener's second ear, wherein the listener's second ear is located on a second side close to the virtual sound source, wherein the second acoustic signal comprises attenuated components in a first band and a second band, the first band is a lowest band and the second band is a second lowest band in a range of one of a first frequency or frequencies higher than the first frequency, the first frequency and the frequencies higher than the first frequency are in bands of appearance of notches, each notch of the notches corresponds to a negative peak of an amplitude having a first depth and a second depth, a first frequency band where the first depth exists is lower than a second frequency band where the second depth exists in the first head acoustic transmission function; and adding a subsidiary signal to the first acoustic signal for generation of a third acoustic signal, wherein the subsidiary signal is constituted by a component in a band of the second acoustic signal, a band of the subsidiary signal comprises:

a lowest band and a second lowest band in a second range of one of a second frequency or frequencies higher than the second frequency in first bands of appearance of the notches in a third head acoustic transmission function, wherein the third head acoustic transmission function is between the listener's first ear and a first speaker on a left side with respect to the listener's position, a lowest band and a second lowest band in one of a third range of a third frequency or frequencies higher than the third frequency in second bands of appearance of the notches in a fourth head acoustic transmission function, wherein the fourth head acoustic transmission function is between the listener's second ear and a second speaker on a right side with respect to the listener's position, a lowest band and a second lowest band in one of a fourth range of a fourth frequency or frequencies higher than the fourth frequency in third bands of appearance of the notches in a fifth head acoustic transmission function, wherein the fifth head acoustic transmission function is between the listener's second ear and the first speaker, and a lowest band and a second lowest band in one of a fifth frequency or frequencies higher than the fifth frequency in fourth bands of appearance of the notches in a sixth head acoustic transmission function, wherein the sixth head acoustic transmission function is between the listener's first ear and the second speaker.

* * * * *